US008585245B2

(12) United States Patent
Black et al.

(10) Patent No.: US 8,585,245 B2
(45) Date of Patent: Nov. 19, 2013

(54) SYSTEMS AND METHODS FOR SEALING A LIGHTING FIXTURE

(75) Inventors: John Black, Bethlehem, CT (US); Keith Tracy, Winsted, CT (US)

(73) Assignee: Integrated Illumination Systems, Inc., Morris, CT (US)

( * ) Notice: Subject to any disclaimer, the term of this patent is extended or adjusted under 35 U.S.C. 154(b) by 496 days.

(21) Appl. No.: 12/766,807

(22) Filed: Apr. 23, 2010

(65) Prior Publication Data

US 2010/0271825 A1 Oct. 28, 2010

Related U.S. Application Data

(60) Provisional application No. 61/172,186, filed on Apr. 23, 2009.

(51) Int. Cl.
*F21V 31/00* (2006.01)
*F21V 15/04* (2006.01)

(52) U.S. Cl.
USPC ..... 362/267; 362/223; 362/217.1; 362/362

(58) Field of Classification Search
USPC ..... 362/267, 223, 217.01, 362, 225, 217.1
See application file for complete search history.

(56) References Cited

U.S. PATENT DOCUMENTS

| | | | | |
|---|---|---|---|---|
| 2,983,813 | A * | 5/1961 | Pfaff, Jr. | 362/223 |
| 4,138,716 | A * | 2/1979 | Muhlethaler et al. | 362/375 |
| 4,139,770 | A | 2/1979 | Beyersdorf | |
| 4,580,200 | A * | 4/1986 | Hess et al. | 362/223 |
| 5,012,395 | A * | 4/1991 | Wettengel et al. | 362/222 |
| 5,264,997 | A | 11/1993 | Hutchisson et al. | |
| 5,465,199 | A | 11/1995 | Bray et al. | |
| 5,561,346 | A | 10/1996 | Byrne | |
| 5,659,582 | A | 8/1997 | Kojima et al. | |
| 5,783,909 | A | 7/1998 | Hochstein | |
| 5,803,579 | A | 9/1998 | Turnbull et al. | |
| 5,909,429 | A | 6/1999 | Satyanarayana et al. | |
| 5,947,587 | A | 9/1999 | Keuper et al. | |
| 6,013,988 | A | 1/2000 | Bucks et al. | |

(Continued)

FOREIGN PATENT DOCUMENTS

WO WO-03/017733 A1 2/2003

OTHER PUBLICATIONS

"1-Wire Products Deliver a Powerful Combination . . . ", Mixed-Signal Design Guide, Dallas Semiconductor Maxim, 2005, 7 pages.
"Conductivity with the BS2/OWL2", EME Systems, 2002, pp. 1-3.

(Continued)

*Primary Examiner* — Peggy A. Neils
(74) *Attorney, Agent, or Firm* — Foley & Lardner LLP; Christopher J. McKenna

(57) ABSTRACT

Systems, methods and apparatuses for providing a reliable enclosure and seal for a system or a device, such as a lighting fixture, are disclosed. The solution presented utilizes a silicone gasket combined with an o-ring chord, an acrylic optic and an extrusion to provide a water-tight, air-tight and water-proof enclosure for the lighting fixture. The seal created by the enclosure is maintained regardless of any temperature or environmental changes, as well as any changes in sizes of the components of the enclosure due to the temperature changes. The silicone gasket, in combination with one or more o-rings, end caps and the extrusion adjust for any expansion or contraction of any components of the enclosure due to temperature changes of the lighting fixture or any other enclosed apparatus, system or device.

20 Claims, 9 Drawing Sheets

(56) References Cited

U.S. PATENT DOCUMENTS 6,016,038 A 1/2000 Mueller et al.
6,040,663 A 3/2000 Bucks et al.
6,094,014 A 7/2000 Bucks et al.
6,127,783 A 10/2000 Pashley et al.
6,147,458 A 11/2000 Bucks et al.
6,150,774 A 11/2000 Mueller et al.
6,157,093 A 12/2000 Giannopoulos et al.
6,166,496 A 12/2000 Lys et al.
6,194,839 B1 2/2001 Chang
6,201,353 B1 3/2001 Chang et al.
6,211,626 B1 4/2001 Lys et al.
6,234,645 B1 5/2001 Borner et al.
6,234,648 B1 5/2001 Borner et al.
6,236,331 B1 5/2001 Dussureault
6,238,065 B1 5/2001 Jones
6,249,088 B1 6/2001 Chang
6,250,774 B1 6/2001 Begemann et al.
6,253,530 B1 7/2001 Price et al.
6,288,497 B1 9/2001 Chang et al.
6,292,901 B1 9/2001 Lys et al.
6,299,329 B1 10/2001 Mui et al.
6,304,464 B1 10/2001 Jacobs et al.
6,305,818 B1 10/2001 Lebens et al.
6,340,864 B1 1/2002 Wacyk
6,340,868 B1 1/2002 Lys et al.
6,384,545 B1 5/2002 Lau
6,411,046 B1 6/2002 Muthu
6,441,558 B1 8/2002 Muthu et al.
6,443,592 B1 9/2002 Unger et al.
6,445,139 B1 9/2002 Marshall et al.
6,459,919 B1 10/2002 Lys et al.
6,489,731 B1 12/2002 Bruning et al.
6,495,964 B1 12/2002 Muthu et al.
6,507,158 B1 1/2003 Wang
6,507,159 B2 1/2003 Muthu
6,510,995 B2 1/2003 Muthu et al.
6,513,949 B1 2/2003 Marshall et al.
6,528,954 B1 3/2003 Lys et al.
6,552,495 B1 4/2003 Chang
6,576,881 B2 6/2003 Muthu et al.
6,577,080 B2 6/2003 Lys et al.
6,577,512 B2 6/2003 Tripathi et al.
6,580,309 B2 6/2003 Jacobs et al.
6,586,890 B2 7/2003 Min et al.
6,596,977 B2 7/2003 Muthu et al.
6,608,453 B2 8/2003 Morgan et al.
6,609,813 B1 8/2003 Showers et al.
6,617,795 B2 9/2003 Bruning
6,621,235 B2 9/2003 Chang
6,630,801 B2 10/2003 Schuurmans
6,636,003 B2 10/2003 Rahm et al.
6,639,368 B2 10/2003 Sheoghong
6,663,261 B1 * 12/2003 Rhee ..... 362/267
6,676,284 B1 1/2004 Wynne Willson
6,692,136 B2 2/2004 Marshall et al.
6,720,745 B2 4/2004 Lys et al.
6,724,159 B2 4/2004 Gutta et al.
6,734,639 B2 5/2004 Chang et al.
6,741,351 B2 5/2004 Marshall et al.
6,762,562 B2 7/2004 Leong
6,777,891 B2 8/2004 Lys et al.
6,788,011 B2 9/2004 Mueller et al.
6,796,680 B1 9/2004 Showers et al.
6,796,686 B2 9/2004 Jacob et al.
6,801,003 B2 10/2004 Schanberger et al.
6,806,659 B1 10/2004 Mueller et al.
6,831,569 B2 12/2004 Wang et al.
6,853,150 B2 2/2005 Clauberg et al.
6,853,151 B2 2/2005 Leong et al.
6,859,644 B2 2/2005 Wang
6,863,424 B2 * 3/2005 Smith ..... 362/455
6,922,022 B2 7/2005 Bucks et al.
6,930,452 B2 8/2005 De Krijger et al.
6,932,477 B2 8/2005 Stanton
6,933,685 B2 8/2005 Gutta et al.
6,933,767 B2 8/2005 Bucks et al.
6,965,205 B2 11/2005 Piepgras et al.
6,969,954 B2 11/2005 Lys
6,972,525 B2 12/2005 Bucks et al.
6,975,079 B2 12/2005 Lys et al.
6,992,803 B2 1/2006 Chang
6,998,594 B2 2/2006 Gaines et al.
7,014,336 B1 3/2006 Ducharme et al.
7,030,572 B2 4/2006 Nijhof et al.
7,031,920 B2 4/2006 Dowling et al.
7,038,398 B1 5/2006 Lys et al.
7,038,399 B2 5/2006 Lys et al.
7,064,498 B2 6/2006 Dowling et al.
7,067,992 B2 6/2006 Leong et al.
7,071,762 B2 7/2006 Xu et al.
7,113,541 B1 9/2006 Lys et al.
7,118,248 B2 10/2006 Wynne Willson
7,132,804 B2 11/2006 Lys et al.
7,135,824 B2 11/2006 Lys et al.
7,139,617 B1 11/2006 Morgan et al.
7,140,752 B2 11/2006 Ashdown
7,161,311 B2 1/2007 Mueller et al.
7,161,313 B2 1/2007 Piepgras et al.
7,161,556 B2 1/2007 Morgan et al.
7,178,941 B2 2/2007 Roberge et al.
7,180,252 B2 2/2007 Lys et al.
7,186,003 B2 3/2007 Dowling et al.
7,202,608 B2 4/2007 Robinson et al.
7,202,613 B2 4/2007 Morgan et al.
7,202,641 B2 4/2007 Claessens et al.
7,204,622 B2 4/2007 Dowling et al.
7,221,104 B2 5/2007 Lys et al.
7,228,190 B2 6/2007 Dowling et al.
7,231,060 B2 6/2007 Dowling et al.
7,233,115 B2 6/2007 Lys
7,233,831 B2 6/2007 Blackwell
7,242,152 B2 7/2007 Dowling et al.
7,253,566 B2 8/2007 Lys et al.
7,255,457 B2 8/2007 Ducharme et al.
7,255,458 B2 8/2007 Ashdown
7,256,554 B2 8/2007 Lys
7,262,559 B2 8/2007 Tripathi et al.
7,267,461 B2 9/2007 Kan et al.
7,274,160 B2 9/2007 Mueller et al.
7,300,192 B2 11/2007 Mueller et al.
7,308,296 B2 12/2007 Lys et al.
7,309,965 B2 12/2007 Dowling et al.
7,314,289 B2 1/2008 Montagne
7,319,298 B2 1/2008 Jungwirth et al.
7,323,676 B2 1/2008 Duijve
7,329,998 B2 2/2008 Jungwirth
7,350,936 B2 4/2008 Ducharme et al.
7,352,138 B2 4/2008 Lys et al.
7,352,339 B2 4/2008 Morgan et al.
7,353,071 B2 4/2008 Blackwell et al.
7,354,172 B2 4/2008 Chemel et al.
7,358,679 B2 4/2008 Lys et al.
7,358,681 B2 4/2008 Robinson et al.
7,358,706 B2 4/2008 Lys
7,358,929 B2 4/2008 Mueller et al.
7,358,961 B2 4/2008 Zwanenburg
7,387,405 B2 6/2008 Ducharme et al.
7,388,665 B2 6/2008 Ashdown
7,394,210 B2 7/2008 Ashdown
7,420,335 B2 9/2008 Robinson et al.
7,423,387 B2 9/2008 Robinson et al.
7,432,668 B2 10/2008 Zwanenburg et al.
7,443,209 B2 10/2008 Chang
7,449,847 B2 11/2008 Schanberger et al.
7,453,217 B2 11/2008 Lys et al.
7,459,864 B2 12/2008 Lys
7,462,997 B2 12/2008 Mueller et al.
7,463,070 B2 12/2008 Wessels
7,482,565 B2 1/2009 Morgan et al.
7,482,760 B2 1/2009 Jungwirth et al.
7,490,953 B2 2/2009 Holten et al.
7,490,957 B2 2/2009 Leong et al.
7,495,671 B2 2/2009 Chemel et al.
7,502,034 B2 3/2009 Chemel et al.

(56) References Cited

U.S. PATENT DOCUMENTS 7,505,395 B2 3/2009 Ashdown et al.
7,507,001 B2 3/2009 Kit
7,511,436 B2 3/2009 Xu
7,511,437 B2 3/2009 Lys et al.
7,515,128 B2 4/2009 Dowling
7,520,634 B2 4/2009 Ducharme et al.
7,521,872 B2 4/2009 Bruning
7,525,254 B2 4/2009 Lys et al.
7,538,499 B2 5/2009 Ashdown
7,542,257 B2 6/2009 McCormick et al.
7,550,931 B2 6/2009 Lys et al.
7,550,935 B2 6/2009 Lys et al.
7,557,521 B2 7/2009 Lys
7,569,807 B2 8/2009 Matheson
7,572,027 B2 * 8/2009 Zampini et al. ..... 362/225
7,572,028 B2 8/2009 Mueller et al.
7,573,209 B2 8/2009 Ashdown et al.
7,573,210 B2 8/2009 Ashdown et al.
7,573,729 B2 8/2009 Elferich et al.
7,598,681 B2 10/2009 Lys et al.
7,598,684 B2 10/2009 Lys et al.
7,598,686 B2 10/2009 Lys et al.
7,619,370 B2 11/2009 Chemel et al.
7,652,236 B2 1/2010 Cortenraad et al.
7,654,703 B2 * 2/2010 Kan et al. ..... 362/362
7,656,366 B2 2/2010 Ashdown
7,658,506 B2 2/2010 Dowling
7,659,673 B2 2/2010 Lys
7,659,674 B2 2/2010 Mueller et al.
7,665,883 B2 2/2010 Matheson
7,667,409 B2 2/2010 Geerts et al.
7,675,238 B2 3/2010 Cortenraad et al.
7,687,753 B2 3/2010 Ashdown
7,688,002 B2 3/2010 Ashdown et al.
7,689,130 B2 3/2010 Ashdown
7,703,951 B2 4/2010 Piepgras et al.
7,710,369 B2 5/2010 Dowling
7,712,926 B2 5/2010 Matheson
7,714,521 B2 5/2010 Qian
7,731,387 B2 6/2010 Cortenraad et al.
7,731,389 B2 6/2010 Draganov et al.
7,731,390 B2 6/2010 Van Gorkom et al.
7,737,643 B2 6/2010 Lys
7,738,002 B2 6/2010 Ashdown et al.
7,740,375 B2 6/2010 Zou et al.
7,766,489 B2 8/2010 Duine et al.
7,766,518 B2 8/2010 Piepgras et al.
7,772,787 B2 8/2010 Ashdown et al.
7,777,427 B2 8/2010 Stalker, III
7,781,979 B2 8/2010 Lys
7,802,902 B2 9/2010 Moss et al.
7,806,558 B2 10/2010 Williamson
7,808,191 B2 10/2010 Wu
7,809,448 B2 10/2010 Lys et al.
7,810,974 B2 10/2010 Van Rijswick et al.
7,845,823 B2 12/2010 Mueller et al.
7,850,347 B2 12/2010 Speier et al.
7,854,539 B2 12/2010 Van Duijneveldt
7,868,562 B2 1/2011 Salsbury et al.
7,878,683 B2 2/2011 Logan et al.
7,878,688 B2 2/2011 Paulussen et al.
7,893,631 B2 2/2011 Speier
7,893,661 B2 2/2011 Ackermann et al.
7,894,050 B2 2/2011 Ashdown et al.
7,906,917 B2 3/2011 Tripathi et al.
7,911,151 B2 3/2011 Xu
7,914,173 B2 3/2011 Paulussen et al.
8,022,632 B2 9/2011 Schulz et al.
8,026,673 B2 9/2011 Lys
8,083,370 B2 * 12/2011 Sloan et al. ..... 362/225
8,376,576 B2 * 2/2013 Sloan et al. ..... 362/249.02
2002/0074559 A1 6/2002 Dowling et al.
2003/0132721 A1 7/2003 Jacobs et al.
2003/0133292 A1 7/2003 Mueller et al.
2004/0052076 A1 3/2004 Mueller et al.
2004/0090191 A1 5/2004 Mueller et al.
2004/0178751 A1 9/2004 Mueller et al.
2005/0007033 A1 * 1/2005 Kan et al. ..... 315/291
2005/0236998 A1 10/2005 Mueller et al.
2005/0275626 A1 12/2005 Mueller et al.
2006/0002110 A1 1/2006 Dowling et al.
2006/0076908 A1 4/2006 Morgan et al.
2006/0114201 A1 6/2006 Chang
2006/0152172 A9 7/2006 Mueller et al.
2006/0221606 A1 10/2006 Dowling
2006/0262521 A1 11/2006 Piepgras et al.
2006/0274526 A1 12/2006 Weston et al.
2006/0290624 A1 12/2006 Ashdown
2007/0063658 A1 3/2007 Van Der Veeken
2007/0086912 A1 4/2007 Dowling et al.
2007/0115658 A1 5/2007 Mueller et al.
2007/0145915 A1 6/2007 Roberge et al.
2007/0153514 A1 7/2007 Dowling et al.
2007/0230159 A1 10/2007 Cortenraad et al.
2007/0258240 A1 11/2007 Ducharme et al.
2007/0273290 A1 11/2007 Ashdown et al.
2008/0042599 A1 2/2008 Ashdown
2008/0043464 A1 2/2008 Ashdown
2008/0048582 A1 2/2008 Robinson
2008/0062413 A1 3/2008 Ashdown et al.
2008/0089060 A1 4/2008 Kondo et al.
2008/0094005 A1 4/2008 Rabiner et al.
2008/0122386 A1 5/2008 De Brouwer et al.
2008/0136331 A1 6/2008 Schmeikal
2008/0136796 A1 6/2008 Dowling
2008/0140231 A1 6/2008 Blackwell et al.
2008/0164826 A1 7/2008 Lys
2008/0164854 A1 7/2008 Lys
2008/0167734 A1 7/2008 Robinson et al.
2008/0183081 A1 7/2008 Lys et al.
2008/0239675 A1 10/2008 Speier
2008/0265797 A1 10/2008 Van Doorn
2008/0278092 A1 11/2008 Lys et al.
2008/0278941 A1 11/2008 Logan et al.
2008/0290251 A1 11/2008 Deurenberg et al.
2008/0297066 A1 12/2008 Meijer et al.
2008/0298330 A1 12/2008 Leitch
2008/0315798 A1 12/2008 Diederiks et al.
2009/0002981 A1 1/2009 Knibbe
2009/0021175 A1 1/2009 Wendt et al.
2009/0021182 A1 1/2009 Sauerlaender
2009/0072761 A1 3/2009 Wessels
2009/0128059 A1 5/2009 Joosen et al.
2009/0134817 A1 5/2009 Jurngwirth et al.
2009/0160364 A1 6/2009 Ackermann et al.
2009/0168415 A1 7/2009 Franciscus Deurenberg et al.
2009/0179587 A1 7/2009 Van Der Veen et al.
2009/0179596 A1 7/2009 Willaert et al.
2009/0189448 A1 7/2009 Verschueren
2009/0224695 A1 9/2009 Van Erp et al.
2009/0230884 A1 9/2009 Van Doorn
2009/0243507 A1 10/2009 Lucero-Vera et al.
2009/0278473 A1 11/2009 Van Erp
2009/0284174 A1 11/2009 Sauerlander et al.
2009/0310354 A1 * 12/2009 Zampini et al. ..... 362/235
2009/0321666 A1 12/2009 Hilgers
2010/0007600 A1 1/2010 Deurenberg et al.
2010/0026191 A1 2/2010 Radermacher et al.
2010/0045478 A1 2/2010 Schulz et al.
2010/0072901 A1 3/2010 De Rijck et al.
2010/0072902 A1 3/2010 Wendt et al.
2010/0079085 A1 4/2010 Wendt et al.
2010/0079091 A1 4/2010 Deixler et al.
2010/0084995 A1 4/2010 Baaijens et al.
2010/0091488 A1 4/2010 Ijzerman et al.
2010/0094439 A1 4/2010 Van De Meulenhof et al.
2010/0102732 A1 4/2010 Peeters et al.
2010/0117543 A1 5/2010 Van Der Veen et al.
2010/0117656 A1 5/2010 Snelten
2010/0118531 A1 5/2010 Montagne
2010/0127633 A1 5/2010 Geerts et al.
2010/0134041 A1 6/2010 Radermacher et al.
2010/0134042 A1 6/2010 Willaert
2010/0148689 A1 6/2010 Morgan et al.

(56) References Cited

U.S. PATENT DOCUMENTS

| | | | | |
|---|---|---|---|---|
| 2010/0164399 | A1 | 7/2010 | Radermacher et al. | |
| 2010/0165618 | A1 | 7/2010 | Vissenberg et al. | |
| 2010/0171771 | A1 | 7/2010 | Otte et al. | |
| 2010/0181936 | A1 | 7/2010 | Radermacher et al. | |
| 2010/0188007 | A1 | 7/2010 | Deppe et al. | |
| 2010/0194293 | A1 | 8/2010 | Deurenberg et al. | |
| 2010/0231133 | A1 | 9/2010 | Lys | |
| 2010/0231363 | A1 | 9/2010 | Knibbe | |
| 2010/0244707 | A1 | 9/2010 | Gaines et al. | |
| 2010/0244734 | A1 | 9/2010 | Van Herpen et al. | |
| 2010/0259182 | A1 | 10/2010 | Man et al. | |
| 2010/0264834 | A1 | 10/2010 | Gaines et al. | |
| 2010/0271825 | A1* | 10/2010 | Black et al. | 362/267 |
| 2010/0271843 | A1 | 10/2010 | Holten et al. | |
| 2010/0289532 | A1 | 11/2010 | Wendt et al. | |
| 2010/0301780 | A1 | 12/2010 | Vinkenvleugel | |
| 2010/0308745 | A1 | 12/2010 | Delnoij | |
| 2011/0025205 | A1 | 2/2011 | Van Rijswick et al. | |
| 2011/0025230 | A1 | 2/2011 | Schulz et al. | |
| 2011/0035404 | A1 | 2/2011 | Morgan et al. | |
| 2011/0042554 | A1 | 2/2011 | Hilgers et al. | |
| 2011/0090684 | A1 | 4/2011 | Logan et al. | |
| 2011/0095694 | A1 | 4/2011 | Justel et al. | |
| 2011/0285292 | A1 | 11/2011 | Mollnow et al. | |
| 2011/0291812 | A1 | 12/2011 | Verbrugh | |
| 2012/0019670 | A1 | 1/2012 | Chang et al. | |

OTHER PUBLICATIONS

"Dimmable Fluorescent Ballast", ATAVRFBKIT/EVLB001, User Guide, ATMEL, 2007, pp. 1-33.

"High-side current sensing for driving a string of white LEDs", EDN, 1 page.

"Understanding Boost Power Stages in Switchmode Power Supplies", Application Report, Texas Instruments, Mixed Signal Products, Mar. 1999, pp. 1-28.

"Understanding Buck Power Stages in Switchmode Power Supplies", Application Report, Texas Instruments, Mixed Signal Products, Mar. 1999, pp. 1-32.

Barberis, C. "Precision current sink costs less than $20", EDN Design Ideas.

Bellcomb Technologies Incoporated, "Edges, Joiners, Attachments", Web Address: http://www.bellcomb.com/caps/edges.htm, Apr. 22, 2007, pp. 1-3.

Bookmarks Menu—Controllers/Wireless—Deisgn Ideas, dated Dec. 6, 2012, 1 pg.

Bowling, S. "Buck-Boost LED Driver Using the PIC16F785 MCU", Microchip, AN1047, 2006, pp. 1-12.

By Staff, Dali Delivers Control and Cost Savings, Headaches Too, Consulting-Specifying Engineer, Jun. 2002, 2 pages.

Canny, D. "Controlling slew times tames EMI in offline supplies", EDN Design Ideas, Nov. 14, 2002.

Control Freak Addict Data Sheet, Copyright 2008, Creative Lighting, 5 pages.

Curtis, K. "High Power IR LED Driver Using the PIC16C781/782", Microchip, TB062, 2002, pp. 1-8.

CybroTech, Managing Lights with Dali, TN-012, rev 2, Cybrotech Ltd., 2007, 11 pgs.

Cypress Perform, Implementing an Integrated DMX512 Receiver, Item ID: 39762, Dec. 16, 2009, 1 pg.

Cypress Semiconductor Corporation, PowerPSoC (R) Intelligent LED Driver, Document No. 001-46319, Rev. G, 2009.

Dali-AG website, Dali at work, 1 pg.

Davidovic, et al., Lead-Acid Battery Charger Becomes a Subfuction in a Microcontroller, The Authority on Emerging Technologies for Design Solutions, Mar. 2007, 2 pages.

Davmark Ltd., Dali-Protocol, 2007, 6 pages.

Di Jasio, "A Technique to Increase the Frequency Resolution of PICmicro MCU PWM Modules", Microchip, AN1050, 2006, pp. 1-10.

Dietz, et al. "Very Low-Cost Sensing and Communication Using Bidirectional LEDs", Mitsubishi Electric Research Laboratories, Jul. 2003, 19 pgs.

Distler, T. "LED Effects Stream TM v2.0 Protocol (Revision C)", Jun. 2, 2005, pp. 1-5.

Dunn, J. "Matching MOSFET Drivers to MOSEFTs", Microchip, AN799, 2004, pp. 1-10.

Fosler, R. "The RS-232/DALI Bridge Interface", Microchip, AN811, 2002, pp. 1-8.

Fosler, R. "Use a microcontroller to design a boost converter", EDN design ideas, Mar. 4, 2004, pp. 74-75.

Fosler, R., et al. "Digitally Addressable DALI Dimming Ballast", Microchip, AN809, 2002, pp. 1-18.

Ghulyani, L. "Simple MPPT-Based Lead Acid Charger Using bq2031", Texas Instruments, Dec. 2009, pp. 1-5.

Google Search Results for dali query group, search completed on Apr. 8, 2010, accessed at google.com, http://www.google.com/search?hl=en&c1ient=firefox-a&rls=org.mozilla:en-, 2 pages.

Hardwick, M. "DC power wire also carries clock or data", EDN Design Ideas.

Hexcel Composites, "Sandwich Panel Fabrication Technology", Web Address: http://www.hexcel.com/NR/rdonlyres/B4574C2C-0644-43AC-96E2-CC15967A4b)5/4547 Sandwich Fabrication.pdf, Jan. 1997, pp. 1-16.

High-Side Current Monitor, ZETEX, Apr. 2001, ZXCT1009, Issue 3, pp. 1-8.

Implementing Infrared Object Detection, http://web.archive.org/web/20080528042614rejwww.seattlerobotics.org/guide/infrared.html, original publication date known, retrieved Apr. 7, 2010, seattlerobotics.org, 4 pages.

Jackson, S. "Circuit protects bus from 5V swings", EDN Design Ideas, Nov. 14, 2002.

Klepin, K. "Temperature Compensation for High Brightness LEDs using EZ-Color (TM) and PSoC Express", Cypress Perform, AN14406, Aug. 10, 2007, pp. 1-4.

Kremin, V. et al. "Multichannel LED Dimmer with CapSense Control—AN13943", Cypress Perform, Jul. 20, 2007.

Kropf, B. "Firmware—RGB Color Mixing Firmware for EZ-Color (TM)—AN16035", Cypress Perform, Jun. 13, 2007, pp. 1-7.

Lager, A. "Use a 555 timer as a switch-mode power supply", EDN Design Ideas, Nov. 14, 2002.

Lee, M. Shunt Battery Charger Provides 1A Continuous Current, EDN Magazine, 1997.

Locher, R. "Introduction to Power MOSEFETs and their Applications", Fairchild Semiconductor (TM), Application Note 558, Rev B, Oct. 1998, 15 pgs.

Miller, R. "Digital addressable lighting interface protocol fosters systems interoperability for lower costs and greater design flexibility", RNM Engineering, Inc., Apr. 2003, pp. 1-20.

Nell, S. "VCO uses programmable logic", EDN Design Ideas, Nov. 14, 2002.

News & Events DALI Digital addressable lighting interface lamp luminaire control, accessed at http://www.dali-ag.org/ on Apr. 8, 2010, original publication date unknown, updated Apr. 8, 2010, 1 pg.

O'Loughlin, M. "350-W, Two-Phase Interleaved PFC Pre-regulator Design Review", Texas Instruments, Application Report, Revised Mar. 2007, pp. 1-.

O'Loughlin, M., PFC Pre-Regulator Frequency Dithering Circuit, Texas Instruments, May 2007, pp. 1-8.

Perrin, R. Inexpensive Relays Form Digital Potentiometer, EDN Design Ideas, 1998, 2 pages.

Petersen, A. "Harness solar power with smart power-conversion techniques", EDN, Green Electronics designfeature, Feb. 4, 1999, pp. 119-124.

Prendergast, P. "How to Design a Three-Channel LED Driver", Cypress Perform, Jan. 2008, pp. 1-9.

Renesas, R8C/25 Demonstration Example for DALI Lighting Protocol Stack, REU05B0077-0100/Rev.1.00, Jul. 2008, 14 pgs.

Richardson, C., Matching Driver to LED, National Semiconductor, Jan. 2008, 5 pgs.

Richardson. C., LM3404 Driving a Seoul Semi Zpower P4 1A LED-RD-I34, National Semiconductor, Apr. 2007, 6 pages.

(56) References Cited

OTHER PUBLICATIONS

Shanmugam, S. "Design of a linear Fresnel lens system for solar photovoltaic electrical power source", Center for Robotics Research.
Shill, M. "Simple logic probe uses bicolor LED", EDN Design Ideas.
Software Design Specification, Z-Wave Protocol Overview, Z wave the wireless language, Zensys A/S, May 9, 2007, pp. 1-16.
Soundlight, Operating Manual, DALI and DMX Dekoder 7064A-H Mk1, 2008, 8 pgs.
Takahashi A., Methods and Features of LED Drivers, National Semiconductor, Mar. 2008, 3 pgs.
Universal Powerline Bus Communication Technology, Overview, PCS Powerline Control Systems UPB (Universal Powerline Bus), Jan. 8, 2002, pp. 1-13.
UPB Technology Description, PCS—Powerline Control Systems, UPB (Universal Powerline Bus), Version 1.4, Apr. 16, 2007, 68 pages.
Use Gate Charge to Design the Gate Drive Circuit for Power MOSEFETs and IGBTs, International Rectifier, Application Note AN-944, 5 pgs.
Van Dorsten, Arian, A Low Cost Step-up Converter by IC 555, posted Jul. 21, 2007, http://www.eleccircuit.comla-low-cost-step-up-converter-by-ic-5551, retrieved Apr. 7, 2010, 2 pages.
Walma, K., DALI: Forerunner of Today's Breakthrough Lighting Technology, Feb. 2007, 2 pages.
Wikipedia, Digital Addressable Lighting Interface, original publication date unknown, Retrieved from:Retrieved from "http://en.wikipedia.org/wikiJDigital_Addressable_Lighting_Interface" accessed on Apr. 8, 2010, 3 pages.
Witt, J. "Switched-capacitor regulator provides gain", EDN Design Ideas.
Wojslaw, C. "DPP adds versatility to VFC", EDN, design ideas, Nov. 14, 2002, pp. 99-110.
Young, R. "Power circuit terminates DDR DRAMs", EDN Design Ideas, Nov. 14, 2002.
Zarr, R. Driving High-Power LEDs, Machine Design, Oct. 2007, 3 pages.
Zensys ASCII Interface, Vizia, 2007.
Zetex, High-Side Current Monitor, Apr. 2001, Issue 3, 8 pages.
Z-Wave Vizia Etc thread, retrieved at http://groups.google.com/group/comp.home.automation/browse_thread/thread/449c2c66934dfSfb/fSl12116a8231aa1?Ink=st&q=z-wave&rnum=98#fSl12116a8231aa1, www.ztech.com, 18 pages.

* cited by examiner

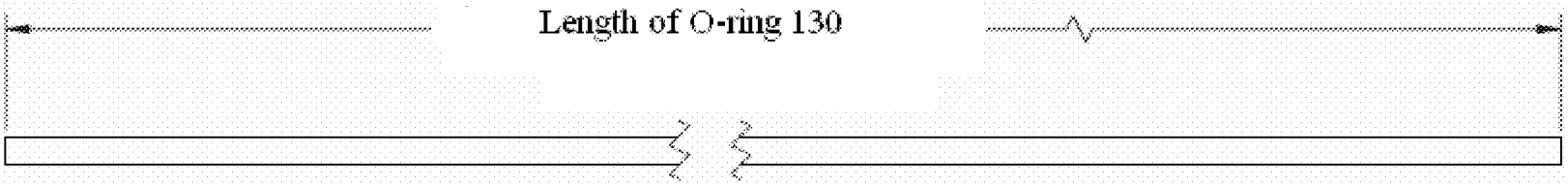

O-ring 130 Examples

| LENGTH ±.125 | PART | DESCRIPTION |
|---|---|---|
| 11.00 | | O-RING, SILICONE, .109 DIAMETER, RED-ORANGE, 12" |
| 12.50 | | O-RING, SILICONE, .109 DIAMETER, RED-ORANGE, 12" |
| 17.00 | | O-RING, SILICONE, .109 DIAMETER, RED-ORANGE, 18" |
| 18.50 | | O-RING, SILICONE, .109 DIAMETER, RED-ORANGE, 18" |
| 23.00 | | O-RING, SILICONE, .109 DIAMETER, RED-ORANGE, 24" |
| 24.50 | | O-RING, SILICONE, .109 DIAMETER, RED-ORANGE, 24" |
| 35.00 | | O-RING, SILICONE, .109 DIAMETER, RED-ORANGE, 36" |
| 36.50 | | O-RING, SILICONE, .109 DIAMETER, RED-ORANGE, 36" |
| 47.00 | | O-RING, SILICONE, .109 DIAMETER, RED-ORANGE, 48" |
| 48.50 | | O-RING, SILICONE, .109 DIAMETER, RED-ORANGE, 48" |

FIG. 7

SYSTEMS AND METHODS FOR SEALING A LIGHTING FIXTURE

RELATED APPLICATIONS

The present application claims priority to U.S. Provisional Application No. 61/172,186 filed on Apr. 23, 2009, which is incorporated herein in its entirety by reference.

FIELD OF THE INVENTION

The present application is generally related to enclosures for systems and devices. In particular, the present application is directed to systems and methods for enclosing and sealing systems and devices.

BACKGROUND

Devices and systems, such as the lighting systems may be used in a variety of applications and deployed in many different settings and environments. Lighting fixtures may be used in environments that are prone to exposure to natural elements, such as rain, snow, heat, cold, humidity, water or wind. These and other natural elements may cause problems and even malfunctions of lighting units which may include electronic and/or electrical components. Short circuit contacts may be caused by water or humidity which may destroy the electronic components such as switches or processors, thus decreasing the life span of the lighting fixtures and increasing the maintenance cost. Shielding the lighting units from these natural elements may become even more challenging as the rates of extension and contraction of different materials used for building the lighting fixtures may vary. This variation in extension and contraction rates between different materials may cause seals to crack along the interfaces of these materials. The cracks may provide openings for leakages, which may be even exacerbated by future contractions and expansions of materials as some parts of lighting units expand much more than other parts.

SUMMARY

The present disclosure addresses these issues by providing a reliable and comprehensive enclosure system that seals a lighting fixture from outside elements. The systems, apparatuses and techniques of the present disclosure provide a lasting seal for the lighting fixture regardless of the rates of expansion and contraction different materials may experience. The systems, apparatuses and techniques described herein also allow for a water-tight seal regardless of sizes and lengths of enclosure components. The solution presented may utilize one or more silicone gaskets in combination with one or more o-ring chords, an acrylic optic and an extrusion to provide a sealed, water-tight and air-tight enclosure for any lighting unit whose enclosure is prone to temperature changes which may induce contractions and/or expansions of materials. The solution presented may also be used to provide a water-tight and air-tight seal for any other unit, electrical or mechanical apparatus, system, object or component having components prone to expansions and contractions. The seal created by the systems, apparatuses and techniques presented is maintained regardless of any changes in temperature or environment as the variation in rates of expansion and contraction of enclosure's components are compensated by other components of the enclosure maintaining the tight seal.

The present disclosure is related to methods, systems or apparatuses for providing a seal to an enclosed object, system, apparatus, device or a matter, such as a lighting fixture or a unit. A lighting fixture may be enclosed or packaged inside an enclosure that comprises an extrusion, such as an aluminum extrusion, a packaging box or any other enclosure. The extrusion may comprise three connected sides: a bottom side and two adjacent sides. Each of the sides may provide a length, a width and a height and may be connected or interfacing with one or more other sides of the extrusion. The extrusion may further comprise two end caps sealing or enclosing each of the two open cross-sectional ends of the extrusion not covered by the extrusion sides. Two silicone gaskets comprised of a flexible material may be positioned or fitted inside each of the two end caps prior to assembling the end caps onto the ends of the extrusion. An extruded acrylic optic may be positioned or fitted in along the length of the opening of the top portion of the extrusion. The acrylic optic may cover any portion of the top side opening not covered by the extrusion sides or the end caps. The optic may cover or protect a light source, such as a light bulb, a neon or a fluorescent tube enclosed within the enclosure. The optic may be reinforced by or interfaced with an o-ring positioned between the optic and the extrusion walls or sides. The o-ring may be acting as an interface providing a pressure and a seal between the optic and the extrusion walls (along the length-height plane). The silicone gaskets may interface with an end of the extruded acrylic optic by pushing against a cross-sectional (width-height plane) section of the extruded acrylic optic. The interface between the silicone gaskets and the ends of the extruded acrylic optic may provide a tight seal. As the optic is tightly fitted between the o-ring on both sides along the length of the extrusion and between the silicone gaskets along the ends of the optic, the enclosure may provide a reliable and lasting water and air impermeable seal.

During the operation of the lighting fixture, as the lighting fixture heats up or cools down, the extruded acrylic optic expands or contracts along with other components of the enclosure. As the optic may comprise a different material from other components of the enclosure, the optic may expand or extend or contract and shrink faster and by a greater rate than other components of the enclosure. Silicone gaskets interfacing with the ends of the optic, in the combination with one or more o-rings interfacing with the sides of the optic and the extrusion, may compensate for these expansions and contractions by deforming. Deformation by the silicone gaskets and the o-rings may fill in any gaps or cracks left by the expanding or contracting optic or any other component of the enclosure. As the optic expands, the optic having a length larger than the width may extend along the length and push against the silicone gaskets inserted into the end caps of the enclosure. The silicone gaskets may morph, reshape and/or contract to absorb the change in length of the optic, thus maintaining the seal of the enclosure. Similarly, when the lighting fixture is cooling after being used, the acrylic optic may shrink and contract and silicone gaskets may morph, reshape and/or expand to fill in any gaps left by the contracting optic. Likewise, the o-ring may also compensate for the shrinkage, movements, expansions and contractions of the optic, thus still maintaining the seal of the enclosure along the length of the optic.

In some aspects, the present disclosure relates to an apparatus providing a water-proof enclosure of an optic of a lighting fixture. The apparatus may include an enclosure having a plurality of connected rectangular sides. The apparatus may also include an optic of a lighting fixture inserted into an extrusion of the enclosure. The extrusion may interfacing with one or more o-rings between the optic and walls of the extrusion. The optic may expand when heated and contract when cooling. The apparatus may further include a deformable gasket at an end of the extrusion comprising at least one hole for receiving an end of the optic and the one or more o-rings. The apparatus may also comprise an end cap of the enclosure comprising a cavity to receive the deformable gasket. Upon inserting an end of the optic into the hole of the deformable gasket received by the end cap and securing the end cap to the extrusion, the apparatus, or the enclosure, may provide a water-proof seal around the end of the optic, the deformable gasket and the extrusion. The deformable gasket may maintain the water-proof seal during expansion and contraction of the optic.

In some embodiments, the deformable gasket comprises a silicon material having a predetermined hardness and flexibility. In further embodiments, a second deformable gasket at a second end of the extrusion received by a second end cap comprises at least a second hole for receiving a second end of the optic and the one or more o-rings. In yet further embodiments, the second deformable gasket at the second of the extrusion secured by the second end cap provides a water-proof seal around the second end of the optic and the one or more o-rings when the second end of the optic is inserted into the second hole. In still further embodiments, the one or more o-rings along with the deformable gasket and the second deformable gasket maintain the waterproof seal between all sides of the optic and the walls the extrusion and the end cap and the second end cap during expansion and contraction of the optic. In yet further embodiments, the deformable gasket and the second deformable gasket maintain the water-tight seal between the ends of the optic.

In some embodiments, the o-rings maintain the water-tight seal between a first side of the optic and a first wall of the extrusion and between a second side of the optic and a second wall of the extrusion during expansion or contraction of the optic. The first wall of the extrusion and the second wall of the extrusion may be adjacent to the end cap and the second end cap. In some embodiments, the optic is shaped to bend along a cross-section of the optic and apply pressure against walls of the extrusion via the one or more o-rings during contraction of the optic and during expansion of the optic. In further embodiments, the optic length from the end of the optic to a second end of the optic is at least four feet long. In yet further embodiments, the extrusion along the length of the optic is at least four feet long.

In some aspects, the present disclosure relates to an enclosure providing a water-tight seal of a lighting fixture. The enclosure may include an extrusion for a lighting fixture. The extrusion may comprise an optic. The enclosure may include one or more o-rings having a predetermined size, flexibility and hardness to provide a water tight interface between the optic and the extrusion. The optic may exert pressure between the one or more o-rings and walls of the extrusion. A silicone gasket may have a predetermined thickness to exert pressure against an end of the optic upon connecting an end cap to an end of the extrusion, the end cap comprising a hole for fitting the silicone gasket. Upon heating of the optic by the lighting fixture, the optic may expand and the end of the optic may press against the silicone gasket to maintain a water-tight seal. The silicone gasket may be deformable to morph, reshape and/or contract to compensate for the expansion of the optic. Upon cooling of the optic, the optic may contract and the silicone gasket may maintain the water-tight seal with the end of the optic as the end of the optic contracts. The silicone gasket may be deformable to morph, reshape and/or expand to compensate for the contraction of the optic.

In some embodiments, the one or more o-rings maintain the water-tight seal between the optic and the walls of the extrusion as the optic expands upon heating and as the optic contracts upon cooling. In further embodiments, a second silicone gasket having a second predetermined thickness to press against a second end of the optic upon and fitting within a hole of a second end cap at a second end of the extrusion. In yet further embodiments, upon heating of the optic, the second end of the optic presses against the second silicone gasket to maintain a water-tight seal, the second silicone gasket deformable to contract to compensate for the expansion of the optic. In further embodiments, upon cooling of the optic, the second silicone gasket maintains the water-tight seal with the second end of the optic as the second end of the expands to compensate for the contraction of the optic.

In some embodiments, the length of the optic between the first end and the second end is at least four feet long. In further embodiments, the optic is shaped to bend along a cross-section of the optic and apply pressure between the optic and the walls of the extrusion via the one or more o-rings during the contraction of the optic and during the expansion of the optic. In further embodiments, the first end cap and the second end cap are applying pressure against the silicone gasket and the second silicone gasket and providing a water-tight seal.

In some aspects, the present disclosure relates to an enclosure providing a water-tight seal of a lighting fixture. An extrusion of an enclosure for a lighting fixture may comprising an optic and one or more o-rings having a predetermined hardness and sized to fit between the optic and the extrusion. The optic may be constructed to exert pressure between the one or more o-rings and the extrusion. The enclosure may further comprise a silicone gasket to exert pressure against the optic upon fitting within an end cap of the extrusion. The end cap may be connected to the extrusion. Upon heating of the optic by the lighting fixture, the optic may expand and press against the silicone gasket to provide a water-right seal. The silicone gasket may morph, reshape and/or contract to compensate for the expanding optic. Upon cooling of the optic, the optic may contract and silicone gasket may maintain the water-tight seal by morphing, reshaping and or expanding to compensate for the contracting optic.

In some embodiments, the silicone gasket comprises one of a rubber, silicone, latex or elastic polymer material. In further embodiments, the silicone gasket comprises the material with an elongation percentage of about 720 when press cured at 5 minutes at 166 Celsius. In still further embodiments, the silicone gasket comprises the material having tear strength of about 15 kN/m when press cured for about 5 minutes at 166 Celisus. In yet further embodiments, the deformable gasket comprises a flexible and deformable material having tensile strength of about 6.5 MPa when press cured for 5 minutes at 166 C.

In some aspects, a lighting fixture providing a water-tight seal to optical components. The lighting fixture may include an acrylic optic positioned along a length of an opening of a extrusion of an enclosure. The lighting fixture may also include an o-ring positioned between the acrylic optic and walls of the extrusion the o-ring providing a pressure and a seal between the acrylic optic and walls of the extrusion. The lighting fixture may include an end cap enclosing a silicone gasket interfacing with an end of the acrylic optic extruding from the extrusion. Deformation by the silicone gasket and the o-ring may fill in gaps created by movement of the acrylic optic responsive to heating or cooling from the lighting fixture, the silicone gasket and the o-ring contracting and expanding to maintain a water-tight seal with the acrylic optic.

BRIEF DESCRIPTION OF THE DRAWINGS

The foregoing and other objects, aspects, features, and advantages of the present invention will become more apparent and better understood by referring to the following description taken in conjunction with the accompanying drawings, in which:

FIG. 7 is a schematic diagram of an embodiment of an o-ring of the lighting fixture enclosure.

The features and advantages of the present invention will become more apparent from the detailed description set forth below when taken in conjunction with the drawings, in which like reference characters identify corresponding elements throughout.

DETAILED DESCRIPTION

A device or an object, such as for example a lighting fixture, may be deployed in a variety of environments and operated under any conditions. Some applications require devices or systems, such as the lighting fixtures, to be deployed in environments exposed to varying natural elements. These natural elements may be any elements, such as snow, water, wind, heat, cold, humidity or pressure. These and similar elements may have a negative effect on many components of the device enclosed, such as for example electronic or electrical circuitry, logic components or wiring. Packaging and protecting the lighting fixtures from such elements by providing a sealed, water and air impermeable enclosure may be accomplished by the systems, apparatuses, techniques and methods described below.

Figure 1A:
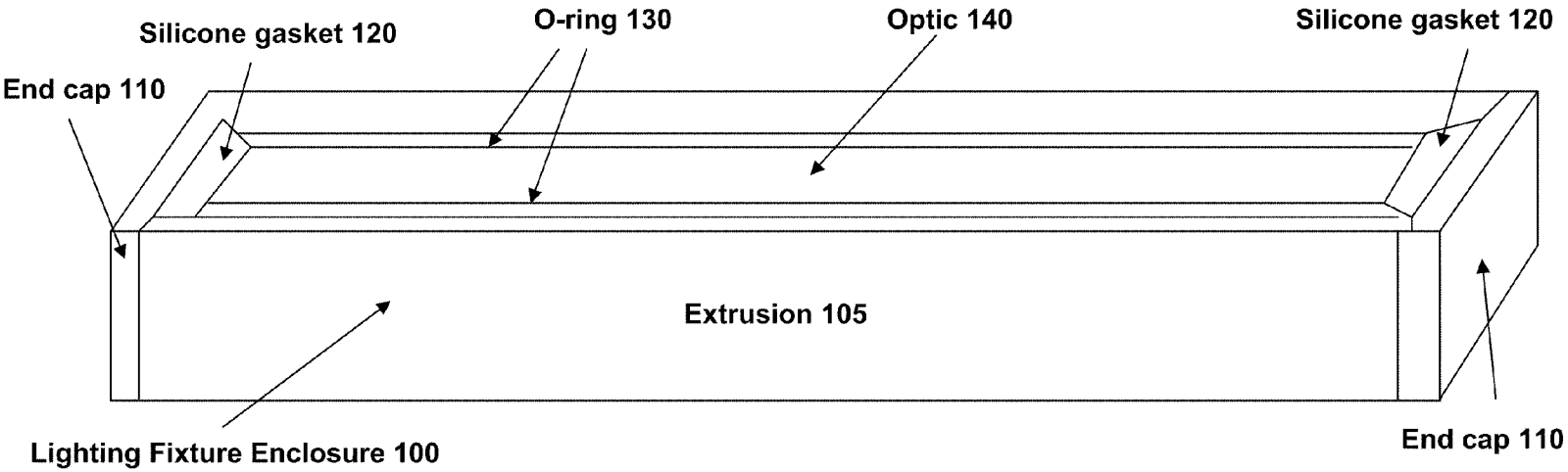
FIG. 1A is a block diagram of an embodiment of a lighting fixture enclosure.

Referring to FIG. 1, an embodiments of an enclosure 100 is depicted. The enclosure 100 may also be referred to as a lighting fixture enclosure 100, or a lighting unit enclosure. The enclosure 100 may comprise an extrusion 105, end caps 110, silicone gaskets 120, o-ring 130 and optic 150. The enclosure 100 may further comprise any additional number of components to be used for a variety of functions. Extrusion 105 may interface with one or more end caps 110. End caps 110 may be connected at one or more ends of the extrusion 105 and may cover any open sides of the extrusion 105. Enclosure 100 may further comprise an extruded acrylic optic, herein also referred to as optic 140. Optic 140 may be interfaced with the extrusion 105 via an o-ring 130. Optic 140 may also be interfaced with the extrusion 105 and any end caps 110 via one or more silicone gaskets 120 positioned on each end of the extrusion 100. Silicone gaskets 120 may be inserted into the hollow portions of end caps 110 and positioned between end caps 110 and the optic 140 providing an interface between an end of optic 140 and an end cap 110. Silicone gaskets 120 may be shaped to interface with features of end caps 110 as well as the cross-sectional shape of the end of optic 140. The assembled enclosure 100 may have an extrusion 105 coupled with end caps 110 and optic 140 via o-ring 130 and silicone gaskets 120. The assembled enclosure 100 may provide a durable, impermeable water-tight and air-tight seal that is not compromised by changes in temperature or any other outside or inside environmental effects.

In further overview, FIG. 1 depicts a lighting fixture enclosure 100, also referred to as enclosure 100. The enclosure 100 may be any enclosure or packaging enclosing, sealing or protecting any type and form of system, object, apparatus or matter, of any type. In some embodiments, enclosure 100 is an enclosure of a lighting device, or a lighting unit. The lighting device or a lighting unit may include any light emitting device or apparatus, such as a lighting fixture, a lamp, a laser, a laser diode, a light emitting diode, an organic light emitting device (OLED), a quantum dot light emitting device (QDLED), or any electromagnetic wave emitting object, apparatus, system or a device. Enclosure 100 may include a packaging or an enclosure for an electrical or an electronic system. In some embodiments, enclosure 100 may enclose a mechanical or optical system or apparatus. In further embodiments, enclosure 100 is an enclosure of a display device or a printed circuit board. In still further embodiments, enclosure 100 is an enclosure enclosing a liquid or a solid matter of organic or inorganic nature. In yet further embodiments, enclosure 100 is any enclosure or packaging enclosing or sealing any type and form of object, matter, unit or device that needs to be protected, packaged or sealed from humidity, water, air or any other natural element.

Enclosure 100 enclose or provide packaging for any object, apparatus, matter or a system using any number of different types of components. Enclosure 100 may be a packaging or an enclosure that comprises a single piece of material or multiple different materials. In some embodiments, enclosure 100 includes any number of parts or components made up of any materials, including metals, such as aluminum, steel, iron or any alloys, as well as plastics and glass, plexiglass, or any transparent material used for covers. The components of the enclosure 100 may include, but not be limited to, extrusion 105, end caps 110, silicone gaskets 120, o-rings such as an o-ring 130, optic 140, end cap covers 145, screws such as end cap screws 150 and any other number of components known to be used for packaging, sealing and enclosing purposes. Enclosure 100 may comprise any number of components made up of same, similar or different type of materials. In some embodiments, enclosure 100 comprises some components that are clear or translucent over any spectral range of light. In further embodiments, enclosure 100 comprises some components whose expansion rates given a temperature change is larger than the expansion rate of other components of the enclosure 100.

Enclosure 100 may be of any size and shape. Depending on the application and the design, the enclosure 100 may be anywhere between 1 millimeter and 100 meters long. Depending on the design, enclosure 100 may have a length of anywhere between 1 inch and 100 feet. For example, enclosure 100 may have a length of about 1 inch, 2 inches, 4 inches, 8 inches, 1 foot, 1.5 feet, 2 feet, 2.5 feet, 3 feet, 3.5 feet, 4 feet, 4.5 feet, 5 feet, 5.5 feet, 6 feet, 6.5 feet, 7 feet, 7.5 feet, 8 feet, 8.5 feet, 9 feet, 9.5 feet, 10 feet, 11 feet, 12 feet, 13 feet, 14 feet, 15 feet, 16 feet, 17 feet, 18 feet, 19 feet, 20 feet, 25 feet, 30 feet, 40 feet, 50 feet, 60 feet, 70 feet, 80 feet, 90 feet or 100 feet. Sometimes, depending on the design, enclosure 100 may be anywhere from 0.01 inches to 3 feet wide. Enclosure 100 may include a width of anywhere between 0.1 inch and 3 feet. In some embodiments, enclosure 100 includes a width of 0.01 inches, 0.05 inches, 0.1 inches, 0.2 inches, 0.4 inches, 0.5 inches, 0.75 inches, 1 inch, 1.5 inches, 2 inches, 2.5 inches, 3 inches, 3.5 inches, 4 inches, 4.5 inches, 5 inches, 5.5 inches, 6 inches, 7 inches, 8, inches, 9 inches, 10 inches, 11 inches, 1 foot, 1.5 feet, 2 feet, 2.5 feet or 3 feet. In some embodiments, enclosure 100 is between 0.01 and 3 feet high. Sometimes, depending on the design, enclosure 100 may have a height of anywhere between 0.01 inches till about 3 feet. In some embodiments, enclosure 100 comprises a height of about 0.01 inches, 0.05 inches, 0.1 inches, 0.2 inches, 0.4 inches, 0.5 inches, 0.75 inches, 1 inch, 1.5 inches, 2 inches, 2.5 inches, 3 inches, 3.5 inches, 4 inches, 4.5 inches, 5 inches, 5.5 inches, 6 inches, 7 inches, 8 inches, 9 inches, 10 inches, 11 inches, 1 foot, 2 feet or 3 feet. The sizes and shapes of the enclosure 100 may vary depending on the environment in which the lighting fixture is used. The size of optic 140 inserted as a top cover for enclosure 100 may also vary in accordance with the size of enclosure 100.

Extrusion 105 may be any extrusion, casing, box, or a piece of material providing an enclosure. In some embodiments, extrusion 105 is an enclosure component, or a plurality of components combined or connected to form an enclosure or a portion of an enclosure for an object, unit, or a device such as a lighting fixture. In some embodiments, extrusion 105 is an aluminum box or an aluminum tube. In other embodiments, extrusion 105 is an enclosing unit or a casing comprising any type and form of material. The extrusion may comprise any material used for manufacturing any type and form of packaging or enclosure. In some embodiments, extrusion 105 includes any metal or an alloy of one or more metals. In other embodiments, extrusion 105 includes any one of, or any combination of: plastic, plexiglass, glass, acrylic, rubber, foam, wood, ceramic, stone or any other type and form of material which may be used to produce an enclosure box, or walls of an enclosure box. In some embodiments, extrusion 105 is clear. In other embodiments, extrusion 105 is opaque. In further embodiments, extrusion 105 is water-tight or air-tight. In still further embodiments, extrusion 105 is custom designed to comprise a material or shape in accordance with special applications the enclosure 100 is used for.

Extrusion 105 may comprise any size and shape. Extrusion 105 may be of any length, width or height. In some embodiments, extrusion 105 of the enclosure 100 comprises a length of anywhere between 1 centimeters and 100 meters. Extrusion 105 may have any size in length, width and/or height of enclosure 100. In some embodiments, extrusion 105 may have a length of about 1 foot, 1.5 feet, 2 feet, 2.5 feet, 3 feet, 3.5 feet, 4 feet, 4.5 feet, 5 feet, 5.5 feet, 6 feet, 6.5 feet, 7 feet, 7.5 feet, 8 feet, 9 feet, 10 feet, 11 feet, 12 feet, 13 feet, 14 feet, 15 feet, 16 feet, 17 feet, 18 feet, 19 feet or 20 feet. In some embodiments, extrusion 105 comprises a width of anywhere between 1 centimeter and 20 meters. Extrusion 105 may have a width of 0.25 inches, 0.5 inches, 0.75 inches, 1 inch, 1.25 inches, 1.50 inches, 1.75 inches, 2 inches, 3 inches, 4 inches, 6 inches, 8 inches, 10 inches, 12 inches, 15 inches, 18 inches, 24 inches or 36 inches. Extrusion 105 may comprise any height between 1 centimeters and 100 centimeters. In some embodiments, extrusion 105 comprises a height of 0.1 inch, 0.25 inch, 0.5 inches, 0.75 inches, 1 inch, 1.25 inches, 1.5 inches, 1.75 inches, 2 inches, 2.5 inches, 3 inches, 4 inches, 5 inches, 6 inches, 7 inches, 8 inches, 9 inches, 10 inches, 12 inches, 18 inches, 24 inches or 36 inches. Extrusion 105 may comprise any type of style or shape. In some embodiments, extrusion 105 may comprise a plurality of sections, each one of which may be shaped differently than other shapes. In some embodiments, extrusion 105 has a rectangular shape. In other embodiments, extrusion 105 has a cylindrical, semi-cylindrical or tube-like shape. In further embodiments, extrusion 105 comprises any number of sides of any length and type. In some embodiments, any number of sides that make up an extrusion 105 may be interconnected, divided with or interfaced with any number of o-rings, such as an o-ring 130.

End cap 110 may be any cap or covering that may be attached to an end of an extrusion 105. In some embodiments, an end cap 110 is a cover of a cross sectional portion of extrusion 105 at the ends of the extrusion, along the width-height plane. Size of end caps 110 may vary based on the size of extrusion 105 and/or enclosure 100. In some embodiments, an end cap 110 is a cap to enclose the ending of the extrusion 105. In further embodiments, an end cap 110 is custom fitted to seal the open ending of the extrusion 105. End cap 110 may comprise any material also comprised by an extrusion 105 or a different material. End cap 110 may be attached to an extrusion via any means, such as screws, hooks, glue, pin or lock. End cap 110 may be interfaced with the extrusion 105, silicone gasket 120 or optic 140 via one or more o-rings, such as an o-ring 130. End cap 110 may be custom fitted to enclose a silicone gasket 120. In some embodiments, end cap 110 comprises a back wall and side walls forming a hollow space into which the silicone gasket 120 is placed or fitted. The end cap 100 may be shaped and sized in a manner to press or compress the silicone gasket 120 against the extrusion 105, optic 140 and the o-ring 130. Compressing the silicone gasket 120 enclosed within the end cap may deform the silicone gasket 120 and ensure that portions of the deformed silicone gasket 120 fill or seal any openings between the end cap 110, extrusion 105, optic 140 and o-ring 130. The end cap 110 may be shaped to provide a specific amount of compression to the silicone gasket 120 upon screwing, or otherwise attaching, the end cap 110 to the extrusion 105.

Silicone gasket 120 may include any component comprising a flexible, deformable and elastic material and formed to interface with components of enclosure 100. Silicone gasket may include any deformable gasket capable of filling in gaps and sealing interfaces with hard materials, such as metals, plastics, optical components, glass and/or plexiglass. Silicone gasket 120 may be a piece of elastic or flexible material of any size or shape formed to interface with optic 140, end cap 110, o-ring 130 and/or extrusion 105. The size and shape of the silicone gasket 120 may be designed or adjusted depending on the shape of the ending portion of the optic 140 that interfaces with the silicone gasket 120. Silicone gasket 120 may interface with, connect to, touch or pushing up against any one of or any combination of: an optic 140, end cap 110, extrusion 105 and o-ring 130. Silicone gasket 120 may be formed or shaped to enclose, engulf or hold any portion of optic 140. Silicone gasket 120 may allow optic 140 to move while maintaining a water-tight and air-tight seal with the optic.

Silicone gasket 120 may include any type and form of elastic, morphing and/or deforming material. Silicone gasket 120 may comprise rubber, latex, silicone, and/or any elastic polymer or elastomer allowing the silicone gasket 120 to change shape and/or morph to compensate for movements of rigid components. In some embodiments, silicone gasket 120 comprises a natural or an artificial rubber. In some embodiments, silicone gasket 120 comprises a flexible or elastic form of silicone. In further embodiments, silicone gasket 120 comprises Elastosil™ by Wacker-Chemie GmBH. In some embodiments, silicone gasket 120 comprises a material that is characterized by any durometer range, such as durometer of about 5-100. In some embodiments, silicone gasket 120 comprises a commercial grade liquid silicone rubber having durometer value of about 20. In further embodiments, silicone gasket 120 comprises a material designed for liquid injection molding. In some embodiments, silicone gasket 120 comprises a translucent material. In further embodiments, silicone gasket 120 comprises a material having a specific gravity at 25 Celsius temperature of 1.11. In some embodiments, silicone gasket 120 comprises a material that is extrusion rate catalyzed at 25 Celsius at 350 g/min. In some embodiments, silicone gasket 120 comprises a material whose tensile strength is 6.5 MPa when press cured 5 min/166 C or 7.9 MPa post cured at 4 hr/204 C. In further embodiments, silicone gasket 120 comprises a material whose tear strength is 15 kN/m when press cured 5 min/166 C and 20 kN/m when post cured 4 hr/204 C. In further embodiments, silicone gasket 120 comprises a material whose elongation percentage is 720 when press cured at 5 min/166 C and 750 when press cured at 4 hr/204 C. Elongation of the silicone gasket 120 may be anywhere between 100 and 1000%. In some embodiments, elongation is about 500, 600, 700, 800 or 900%.

Silicone gasket 120 may be designed to have any size and shape to interface with enclosure 100 components. In some embodiments, the size and shape of the silicone gasket 120 is determined based on the size and shape of the end caps 110, o-ring 130 and optic 140. Silicone gasket 120 may include a through hole through which optic 140 is inserted. In such embodiments, silicone gasket 120 may provide a seal by tightly surrounding a cross-sectional portion of optic 140 while the optic contracts or expands. When optic 140 is inserted through the hole of the silicone gasket 120, the seal between the silicone gasket and the optic 140 is tight as the optic is snug against the walls of the silicone gasket 120. In some embodiments, silicone gasket 120 comprises a hole that is not a through-hole and that has a bottom within the silicone gasket 120. Optic 140 may be inserted into the hole and may press against the bottom or be snug with the bottom of the silicone gasket 120. In such embodiments, silicone gasket 120 may morph, reshape, contract or expand, enabling the end of the optic 140 pressing against silicone gasket 120 to move in an out of the hole, while the bottom and the surrounding sides of the silicone gasket 120 adjust to maintain the seal around optic 140. Silicone gasket 120 may further be shaped to interface with o-ring 130. In some embodiments, silicone gasket 120 comprises a hole, slit or a dent to interface with the o-ring 130. In other embodiments, silicone gasket 120 is shaped to have a snug fit within the end cap 110 as well as have a tight seal with the optic 140 and the o-ring 130.

In some embodiments, silicone gasket 120 may comprise a material with specifications as shown in the table below:

| Properties* | Characteristics | | Test Method |
|---|---|---|---|
| Appearance | Translucent | | WSTM-2298 |
| Specific Gravity, 25° C. | 1.11 | | WSTM-1261 |
| Extrusion Rate Catalyzed, 25° C., g/min** | 350 | | WSTM-2299 |
| Pot Life, hrs, 25° C.*** | 48 | | WSTM-2299 |
| | Press Cured 5 min/166° C. | Post Cured 4 hr/204° C. | |
| Hardness, Shore A | 22 | 24 | WSTM-1110 |
| Tensile Strength, | | | |
| MPa | 6.5 | 7.9 | WSTM-1160 |
| psi | 942 | 1150 | |
| Elongation, % | 720 | 750 | WSTM-1160 |
| Tear Strength, die B, | | | |
| kN/m | 15 | 20 | WSTM-1160 |
| ppi | 86 | 114 | |

-continued

| Properties* | Characteristics | | Test Method |
|---|---|---|---|
| Compression Set, Method B (22 hr/177° C.), % | 60 | 15 | WSTM-1114 |
| Shrink, % | 3.0 | 3.9 | WSTM-2316 |
| Brittle Point, ° C. | NA | −73 | ASTM-D746 |

*Properties obtained after mixing part A and part B in a ratio of 1:1.
**Extrusion rate obtained at 90 psi and 0.125 inch aritice.
***Pot life determined by time required for extrusion rate to the reduced to 50% of initial value.

O-ring 130 may be any type and form of gasket comprising a flexible or elastic material. O-ring 130 may be any gasket acting as a water-tight and air-tight interface between the optic 140 and the extrusion 105. In some embodiments, o-ring 130 is a chord of flexible and elastic material comprising a specific length and diameter. In further embodiments, o-ring 130 is a chord comprising a length, width and thickness. In further embodiments, o-ring 130 is a ring-shaped or donut-shaped gasket. O-ring 130 may be installed or inserted between the optic 140 and the walls of extrusion 105. O-ring 130 may be installed between a silicone gasket 120 and an optic 140. In further embodiments, o-ring 130 is installed between any two or more components of the extrusion 105, such as extrusion sides. In yet further embodiments, o-ring 130 is installed between the end cap 110 and the extrusion, between the end cap 110 and the silicone gasket or between the silicone gasket and the optic 140.

O-ring 130 may comprise any type and form of material. In some embodiments, o-ring 130 comprises an elastomer, such as a rubber or a latex. In further embodiments, o-ring 130 comprises a silicone compound. In yet further embodiments, o-ring 130 comprises a Silicone compound, such as $M2GE706A_{19}B_{37}EA_{14}EO_{16}EO_{36}G_{11}Z_1$. The hardness of the o-ring 130 material may be between 60 and 70 durometers. In some embodiments, the o-ring 130 material may comprise tensile strength of 1000 psi. In further embodiments, o-ring 130 material may comprise elongation percentage of 225. In further embodiments, the specific gravity of the o-ring 130 material is 1.26. In some embodiments, at 70 hours at 225 Celsius durometer of the o-ring 130 material may change by about −5 durometers from the original. In further embodiments, at 70 hours at 225 Celsius tensile of the o-ring 130 material may change by −20 percent from the original. In still further embodiments, the o-ring 130 material may comprise the tear resistance of 10 kN/m. O-ring 130 may be of any color, such as orange, red or black.

Some embodiments of the o-ring 130 are provided in the table below:

| LENGTH ± .125 | PART NUMBER | DESCRIPTION |
|---|---|---|
| 11.00 | 7120126-2T12 | O-RING, SILICONE, .109 DIAMETER, RED-ORANGE, 12" |
| 12.50 | 7120126-2B12 | O-RING, SILICONE, .109 DIAMETER, RED-ORANGE, 12" |
| 17.00 | 7120126-2T18 | O-RING, SILICONE, .109 DIAMETER, RED-ORANGE, 18" |
| 18.50 | 7120126-2B18 | O-RING, SILICONE, .109 DIAMETER, RED-ORANGE, 18" |
| 23.00 | 7120126-2T24 | O-RING, SILICONE, .109 DIAMETER, RED-ORANGE, 24" |
| 24.50 | 7120196-2B24 | O-RING, SILICONE, .109 DIAMETER, RED-ORANGE, 24" |

-continued

| LENGTH ± .125 | PART NUMBER | DESCRIPTION |
|---|---|---|
| 35.00 | 7120126-2T36 | O-RING, SILICONE, .109 DIAMETER, RED-ORANGE, 36" |
| 36.50 | 7120126-2B36 | O-RING, SILICONE, .109 DIAMETER, RED-ORANGE, 36" |
| 47.00 | 7120126-2T48 | O-RING, SILICONE, .109 DIAMETER, RED-ORANGE, 48" |
| 48.50 | 7120126-2B48 | O-RING, SILICONE, .109 DIAMETER, RED-ORANGE, 48" |

In some embodiments, the materials of the o-ring 130 comprises any of the specifications as described in the table below:

Material Report: S7551-65

| Original Physicals | ASTM D2000 | ASTM Method | Results |
|---|---|---|---|
| Durometer, Shore A | | D2240 | 65 |
| Tensile, psi | | D412 | 1000 |
| Elongation, % | | D412 | 225 |
| 100% Modulus, psi | | D412 | 400 |
| Specific Gravity | | D297 | 1.26 |
| Heat Resistance | A19 | D573 | |
| 70 hrs @ 225° C. | | | |
| Durometer Change, pts | | | −5 |
| Tensile Change, % | | | −20 |
| Elongation Change, % | | | −15 |
| Compression Set | B37 | D395 | |
| 22 hrs @ 175° C., % | | | 25 |
| Fluid Age, Water | EA14 | D471 | |
| 70 hrs. @ 100° C. | | | |
| Durometer Change, pts. | | | −2 |
| Volume Change, % | | | 2 |
| Fluid Age, # 1 OIL | EO16 | D471 | |
| 70 hrs. @ 150° C. | | | |
| Durometer Change, pts. | | | −10 |
| Tensile Change, % | | | 15 |
| Elongation Change, % | | | −10 |
| Volume Change, % | | | 5 |
| Fluid Age, # 903 OIL | EO36 | D471 | |
| 70 hrs. @ 150° C. | | | |
| Durometer Change, pts. | | | −25 |
| Tensile Change, % | | | −25 |
| Elongation Change, % | | | −30 |
| Volume Change, % | | | 45 |
| Tear Resistance | G11 | D624 | |
| Die B, kN/m | | | 18 |

Optic 140 may comprise any type and form of material and may be used to cover a top portion of the enclosure 100. In some embodiments, optic 140 comprises any type and form of translucent or semi-translucent material. In yet further embodiments, optic 140 comprises a material from which, or through which, an electromagnetic wave can be emitted or transmitted. In some embodiments, optic 140 comprises an opaque material, such as for example a metal or any material that may be comprised by an extrusion 105. In some embodiments, optic 140 comprises an acrylic. In still further embodiments, optic 140 comprises an extruded acrylic. In some embodiments, optic 140 comprises plexiglass. In yet further embodiments, optic 140 comprises glass. In still further embodiments, optic 140 comprises any type and form of plastic. Optic 140 may comprise any type and form of material which is transparent or partially transparent to any type and form of emitted electromagnetic wave or light. Optic 140 may further comprise an edge, such as an edge disclosed in FIG. 6 to enable improved interfacing with o-ring 130.

Optic 140 may serve as light guide or a light renderer of an enclosed light emitting device. In some embodiments, lighting fixture comprises one or more light emitting diodes or LEDs. The LEDs may emit light of any type, power or spectral range. The lighting fixture may further comprise neon lamps, fluorescent lamps, light bulbs, laser diodes or any other type or form of light emitting device. Optic 140 may provide light rendering, diffusion or light guiding for the light emitted by the LEDs of the lighting fixture. In some embodiments, Optic 140 serves as a cover and protector for the LEDs or light sources enclosed within the lighting fixture.

Optic 140 may be designed and constructed to comprise any extension or shrinkage rates. In some embodiments, optic 140 is manufactured to ensure a specific shrinkage/expansion rate or to ensure a range of shrinkage rate. In some embodiments, optic 140 comprises a shrinkage rate of between 0 and 1%. In further embodiments, optic 140 comprises a shrinkage rate of between 1-2%. In further embodiments, optic 140 comprises shrinkage rate of about 2, 3, 4, 5, 6, 7, 8, 9, 10, 11, 12, 13, 14, 15, 16, 17, 18, 19, 20, 25, 30, 35, 40 and 50 percent. Optic 140 may be manufactured and tested in any way to ensure any range of shrinkage rate percentage.

Optic 140 may comprise any size and shape to interface with the extrusion 105, end cap 110, o-ring 130 or silicone gasket 120. In some embodiments, optic 140 is shaped as a semi-circular tube. In other embodiments, optic 140 is hollow. In further embodiments, optic 140 is designed to provide a specific tension when pushing against o-ring 130, extrusion 105 and silicone gasket 120 to provide a tight seal. In yet further embodiments, optic 140 comprises an elongated tube whose cross-section plane (width-height plane) resembles a circle, an oval, a half-circle, a half oval, a crescent-like shape or an irregular custom shape, such as a shape of turtle-shell as shown in cross-sectional plane of FIG. 6. In some embodiments, an optic 140 has a rectangular shape in length and width plane (top view plane). In further embodiments, optic 140 comprises a crescent-like, semicircular or circular shape in width and height plane (cross-section plane). The cross-section plane of the optic 140 may be shaped as a square or a rectangle. In some embodiments, the cross-section plane of the optic 140 may be shaped as a curved thin rectangle. In such embodiments, the optic 140 comprises equal thickness along the cross-section, but the optic 140 is compressed against the sides of the extrusion 105 and thus bent and compressed. Optic 140 may be fitted or positioned between two sides of the extrusion 105 and provide pressure against the o-ring 130 interfacing between the extrusion 105 and optic 140. Similarly, the optic 140 may apply the pressure against the walls of the silicone gasket 120 through which, or into which, the optic 140 is inserted. In some embodiments, once the optic 140 is installed and interfacing with one or more o-rings 130, silicone gaskets 120, extrusion 105 and end caps 110, the enclosure 100 is sealed.

Further embodiments of optic 140 are disclosed in the table below:

| PART NUMBER | FINISHED LENGTH 3 |
|---|---|
| 9008-A-12 | 11.880 |
| 9008-A-18 | 18.140 |
| 9008-A-24 | 23.880 |
| 9008-A-36 | 35.880 |
| 9008-A-48 | 47.880 |

Optic 140 of about 4 feet length may extend by about 0.2 inches due to heating of the lighting fixture. During the manufacturing of the optic 140, the optic 140 may be annealed at a temperature of between 80 and 120 Celsius, such as for example 95 Celsius to decrease the shrinkage rate of the optic 140.

Still referring to FIG. 1, an example of an embodiment of an air-tight, water-tight and/or water-proof enclosure 100 of a lighting fixture is depicted. In this example, an extrusion 105 may expand or extend less than the optic 140. Extrusion 105 of the enclosure 100 may comprise a metal or metal alloy casing having three connected rectangular sides. The sides of the extrusion 105 may comprise any number of dents, ribs or fins oriented in a vertical, horizontal, or any other fashion. The extrusion 105 may be of any length, such as 4, 6, 8 or 12 feet. Extrusion 105 may be about 1.5 inches wide and about 2 inches high. Two metal alloy end caps 110 may be connected to two ends of the extrusion 105 capping off the ends of the extrusion. The end caps 110 may have a width of about 1.5 inches and a height of about 2 inches to match the ending of the extrusion 105. The end caps 110 may enclose one or more silicone gaskets 120.

In a further example, the lighting fixture emits about 15 watts of light per foot of length of the lighting fixture. As the lighting fixture operates on this power, the lighting fixture and the enclosure 100 may heat up. As the lighting fixture may comprise length of 4, 6, 8, 12 or more feet, some components of the lighting fixture may expand due to change in temperature of the device. The silicone gaskets 120 may comprise one or more holes into which one of each ends of the optic 140 is inserted. As the optic 140 or any other component of the enclosure 100 expands or contracts, the silicone gasket 120 compensates for the expansion or contraction, thus maintaining the seal. The silicone gaskets 120 may comprise one or more through holes through which one of each ends of the optic 140 is inserted. The silicone gaskets 120 may be designed to provide a tight seal around the optic 140, thus preventing any leakage of air or water between the optic 140 and the end cap 110 regardless of the changes in sizes due to temperature changes of either optic 140 or the end caps 110. The silicone gasket 120 may further be designed to provide a tight seal between the extrusion 105 and the end caps 110 once the end caps 110 are attached to the extrusion 105. The silicone gasket 120 may provide the seal by deforming to compensate for any change in size or shape by any of the enclosure 100 components. In some embodiments, there are two or more silicone gaskets 120 of same or different shape and size on each side of the optic 140. Some silicone gaskets 120 may comprise through holes, while others may comprise holes which are not through holes. Once the end of the optic 130 is inserted into the silicone gasket 120 enclosed within an end cap 110, the silicone gasket 120 may compress or contract whenever the optic 140 expands, extends or increases in size due to temperature change. Similarly, the silicone gasket 120 may decompress or expand whenever the optic 130 shrinks, shortens or decreases in size due to any temperature change. The silicone gasket 120 may similarly also shrink or expand and therefore compensate for any movements of extrusion 105 or end cap 110. Therefore, the silicone gasket 120 may maintain the watertight seal despite any movements of the optic, extrusion 105 or end cap 110 due to any changes in temperature.

O-ring 130 may be designed to have a specific hardness, flexibility, size and shape to fit snuggly between the optic 140 and the extrusion 105. In addition, the o-ring 130 may comprise elasticity to stretch and compress along with any movements of the optic 140 or the extrusion 105. The o-ring 130 may further be greased to minimize wear and tear while the optic 140 extends and contracts with changes in temperature of the lighting fixture. The o-ring 130 may also be interfaced with the silicone gasket 130 to enable a tight seal in the corner connections of the silicone gaskets 120, extrusion 105, end cap 110 and the o-ring 130. The o-ring 130 may be lined or kept in place by a groove in the extrusion 105.

The optic 140 may be inserted into the extrusion from the top opening of the extrusion 105. The optic 140 may be shaped to provide compression, or push against the o-ring 130 which interfaces between the extrusion 105 and optic 140. The optic 140 may further be shaped to provide compression, or exert pressure against the silicone gaskets 120 and the end caps 110. The optic 140 may be kept in place by a groove of the extrusion 105. The silicone gasket 120 may comprise a specific thickness such that when the end caps 110 are connected to the ends of the extrusion 105, a pressure is exerted by the silicone gasket 120 against the ends of the optic 140. As the optic 140 is heated by the lighting fixture, the optic 140 may expand and further press against the extrusion 105 and end cap 110, thus maintaining the water tight seal of the enclosure 100. Similarly, as the optic 140 cools off, the optic 140 will shrink or contract, however a sufficient pressure to maintain the water-tight seal will be exerted by the optic 140 against the extrusion 105 and the silicone gaskets 120, as well as the end caps 110. As such, the lighting fixture enclosure 100 maintains the water-tight, water-proof and air-tight seal despite any changes in the temperature caused by the lighting fixture or the outside environment.

In another example, the end caps 110 are aluminum end caps. The end caps 110 provide the cavity into which the silicone gasket 120 is compressed. Silicone gasket 120 may be a silicone rubber gasket. End caps 110 and the silicone gaskets 120 for each of the end caps 110 may be designed so that the silicone gasket 120 thickness is greater than the depth of the cavity of the end caps 110 into which the gaskets 120 are inserted. As such, the silicone gaskets 120 may be compressed as the end caps 110 are attached or screwed onto the extrusion 105. In some embodiments, end caps 110 and the silicone gaskets 120 are designed so that the silicone gaskets 120 are compressed by about 0.05 inches, or that the silicone gaskets 120 provide about 0.05 inches of compression against the extrusion 105 or optic 140. End caps 110 may further comprise 5 screw holes for ensuring the pressure applied to the silicone gaskets 120 is even.

In a further example, an optic expansion pocket may be calculated such that when the optic 140 expands under heating conditions, it has room to expand into the end cap 110. The design may account for any changes in size of the optic 140, or any other component of the enclosure 100 such that the contact between the silicone gasket 120 does not lapse or changes. This design provides a lasting seal regardless of any changes in the size of the optic 140 or any other component of the enclosure 100.

An overhanging lip on the end cap 110 or an extrusion 105 may keep a silicone gasket 120 from extruding out of the cavity. The design may ensure that the only area where the silicone gasket 120 has an opportunity to expand or extrude is at the top side of the enclosure where the optic 140 is located. As that area remains exposed and the silicone gasket 120 may expand into that area when the additional pressure is applied due to the expansion of the optic 140. The overhanging lip may keep downward pressure on the gasket where it comes in contact with the optic 140, thus providing seal. The overhanging lip may also keep the silicone gasket 120 in tact during expansion and contraction phases.

A chamfered internal edge adds may also be added to the design. The chamfered internal edge may increase the manufacturability of the design. When the silicone gasket 120 is compressed the tapered edge may lead the silicone gasket 120 into position keeping it from pinching or bowing. Similar edges may be added to the extrusion for the purpose of maintaining an o-ring 130 in position or maintaining optic 140 in position.

In a further example, silicone gasket 120 may be cut from a sheet of molded sheet rubber. The molded sheet rubber may have a low durometer values, or moderately low durometer values. The molded sheet rubber may have durometer values, such as about 20 durometers. The molded sheet rubber may also have a relatively high elongation at break percentage, such as 650-750%. The relatively high elongation at break percentage may enable providing more even pressure on the areas where the sealing is provided, such as the optic 140. By compressing silicone gasket 120 by about 0.05 inches on a 0.188 inch thick silicone gasket 120, the silicone gasket 120 is compressed about 26.5% at nominal dimensions. In some embodiments, for every 50% of compression the internal elongation of the material is over 100%. As such, the design may be adjusted to exhibit a roughly 50% internal elongation of the material. This amount of internal elongation may still be sufficiently far from the maximum allowed, enabling the design to provide the seal within the spec of the material. This design may also prevent bowing or pinching of the silicone gasket 120 unevenly during compression. The combination of the material selected, compression, and durometer of the material may all come together to make the silicone gasket 120 to seal the design.

In a further example, compression testing for a design of the components of the enclosure 100 may provide following results. The test may be performed with 30 Durometer Silicone Sheet Rubber from Diversified Silicone Products, 0.188" Thick, Compression −0.040"—Material fills the hole 0.056" Compression −0.030—Material fills the hole 0.042". The silicone gasket may come in on the low end tolerance of the thickness, material to compress may be down to 0.008". If the machined end cap comes in on the low end tolerance of the depth of the pocket, material to compress will be down 0.005". These tolerances may take 0.013" off of our thickness of material to compress. This may bring our calculated 0.040 compression down to 0.027". At 0.027" compression, the material may fill approximately 0.042". If the optic comes in on the small side, it may be 0.006" smaller. If the gasket cut comes in on the high side, it may be 0.007" larger. The dimensions of the silicone gasket 120 may be undersized by 0.003 as compared to the optic. If the machined end cap comes in on the high end width tolerance of the pocket, the gasket may fill out an additional 0.003". The dimensions of the silicone gasket 120 may be oversized by 0.002 as compared to the end cap pocket. When these tolerances are added: 0.006+0.007+0.003=0.016". There may be an additional 0.016" that may be subtracted from our 0.042" compression on the low end tolerance. This may leave us with 0.026" of compression at one scenario for analysis. As such, the conclusion may be that even at 0.026" of compression, the enclosure 100 may still adequately seal. In addition, silicone grease may be used as an additional sealant on the silicone gaskets 120. Silicone grease may also provide additional level of protection and may improve the sealing.

Further information regarding the analysis is provided in the table below:

| | Tolerance | |
|---|---|---|
| Part | Low | High |
| Gasket Thickness | −0.008 | 0.008 |
| Gasket Cut (Waterjet) | −0.01 | 0.01 |
| Optic | −0.006 | 0.006 |
| End Cap Machining | −0.005 | 0.005 |

Grease, such as the silicone grease, may be used on the inside of the optic 140 cavity of the silicone gasket 120 or on the optic 140. The grease may also be used between the optic 140 and the o-ring 130. In some embodiments, the grease fills in any microscopic scratches and cracks, thus providing a seal. In further embodiments, the grease provides a lubricant for the piston effect of the optic 140 as the optic shrinks and contracts. In some embodiments, based on the coefficient of thermal expansion of the optic 140 may change the length by about 0.200" inches (assuming 48" nominal optic length) when cycled from −30 C to +60 C. If the optic 140 is heated to a higher temperature, optic 140 may change the length by more than 0.200", such as 0.25", 0.30", 0.35", 0.40", 0.45", 0.5", 0.55", 0.6", 0.7", 0.8", 0.9" and 1.0". Changes in length may be linear or otherwise related to the length of the optic 140. As the optic is aggressive in moving, the grease may ensure that the optic 140 will not pinch or pull the silicone gasket 120 during this movement.

In a further example, assembly of the enclosure of the lighting fixture may start with adding some grease to the inside of the optic cavity of the silicone gasket. Once the silicone gasket has been pre-greased, it may be slid onto the optic overhanging the extrusion and the 4 o-rings also overhanging the extrusion may be slid through the gasket. The o-rings may be cut flush with the outward face of the gasket which may be compressed against the end cap. The end cap then may be slid over the top of the gasket and compressed by evenly tightening the 5 screws which are inserted through the end cap, through the gasket, and into the threaded holes in the extrusion. When the screws compress the gasket, the openings in the gasket may begin to squeeze. The holes for the screws may be compressed around the screw and seal it. The outside of the interface between the end cap and the extrusion may also be sealed by this compression of the gasket against the flat of the extrusion. The gasket over the top of the optic may also seal and the lip on the end cap may be keep even downward pressure against the optic. In some embodiments, all four o-rings may be compressed around and sealed while the ones on the top are also tightly squeezed against the side of the optic keeping it sealed. The label may be added and the end cap assembly may then be complete.

The enclosure may be tested with thermal shock tests from −25 C to +55 C and tested with a hydrogen leak tester to conform at the extremes as well as during the cycle when the optic is moving the most. In order to guarantee air tight seal prior to shipment of the enclosure, in-process Hydrogen leak test may be used. This method may also used in the air conditioning and refrigeration industries where complete sealing is considered important. Hydrogen testing may provide instant results on leaks that would normally be too small to even be detected by other methods with a sensitivity of <0.5 ppm. The Hydrogen Leak Test may be performed on each lighting fixture after which they are vacuumed and filled with Nitrogen gas to further promote a dry internal cavity of the fixture.

Figure 1B:
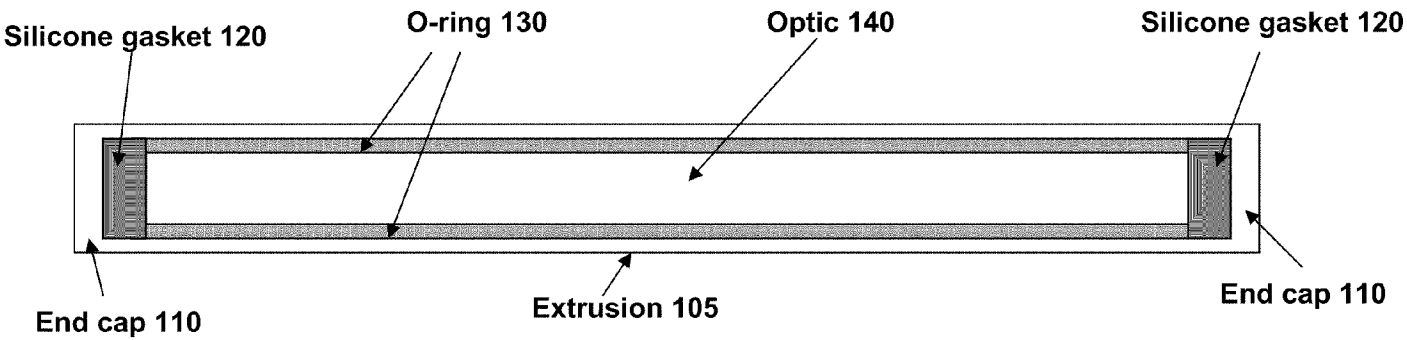
FIG. 1B is a top view diagram of an embodiment of a lighting fixture enclosure.

Referring now to FIG. 1B, a top view of the lighting fixture enclosure is depicted. The extrusion 105 is depicted around the perimeter, providing the outside edge. Enclosed are the silicone gaskets 120, optic 140 and the o-ring 130. In some embodiments, the enclosure 100 comprises any number of o-rings 130 positioned on either side of the extrusion 105 or between any other two components of the enclosure 100. The optic 140 is installed in between the silicone gaskets 120 and the o-ring 130, exerting pressure against the o-ring 130 and the silicone gaskets 120 and thus providing the seal.

Figure 2:
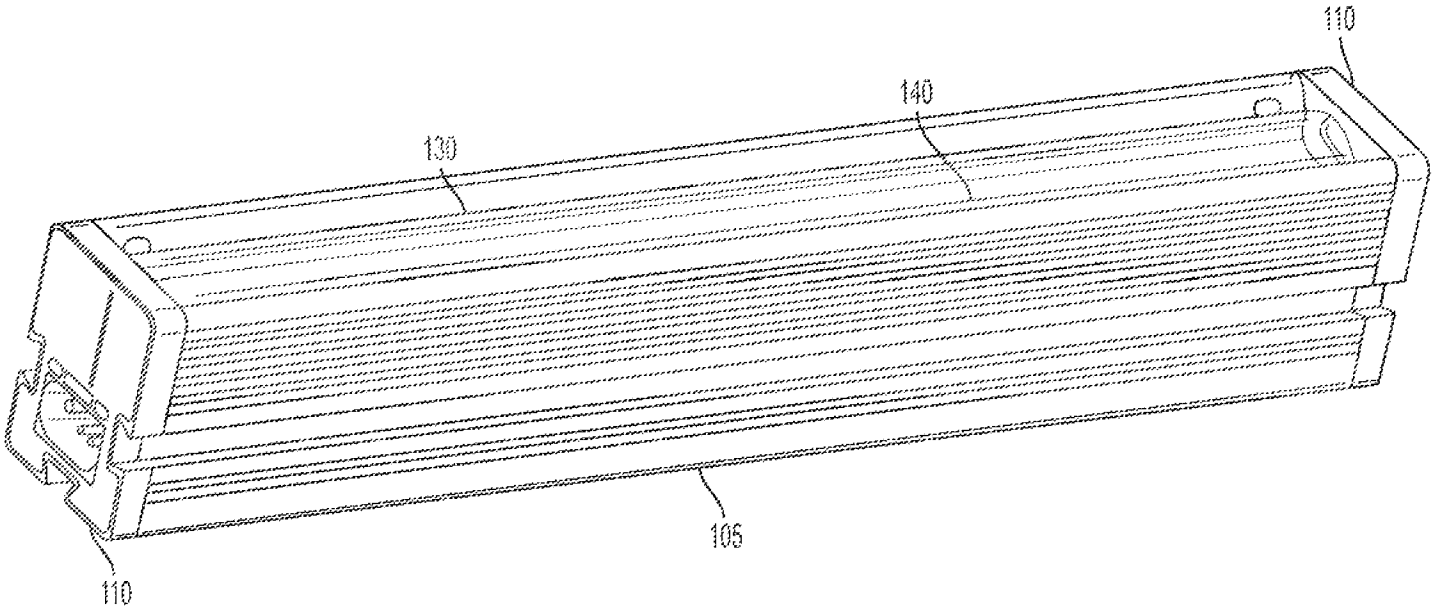
FIG. 2 is a drawing of an embodiment of an assembled lighting fixture enclosure.

Referring now to FIG. 2, an embodiment of an assembled lighting fixture enclosure 100 is depicted. Enclosure 100 comprises an aluminum extrusion 105 having horizontal grooves. The end caps 110 are attached to each side of the extrusion 105. The o-ring 130 is positioned between the optic 140 and the aluminum extrusion 105. The optic 140 is inserted into the silicone gaskets 120 inside each of the end caps 110. The assembled lighting fixture enclosure 100 is sealed and provides protection against outside natural elements.

Figure 3:
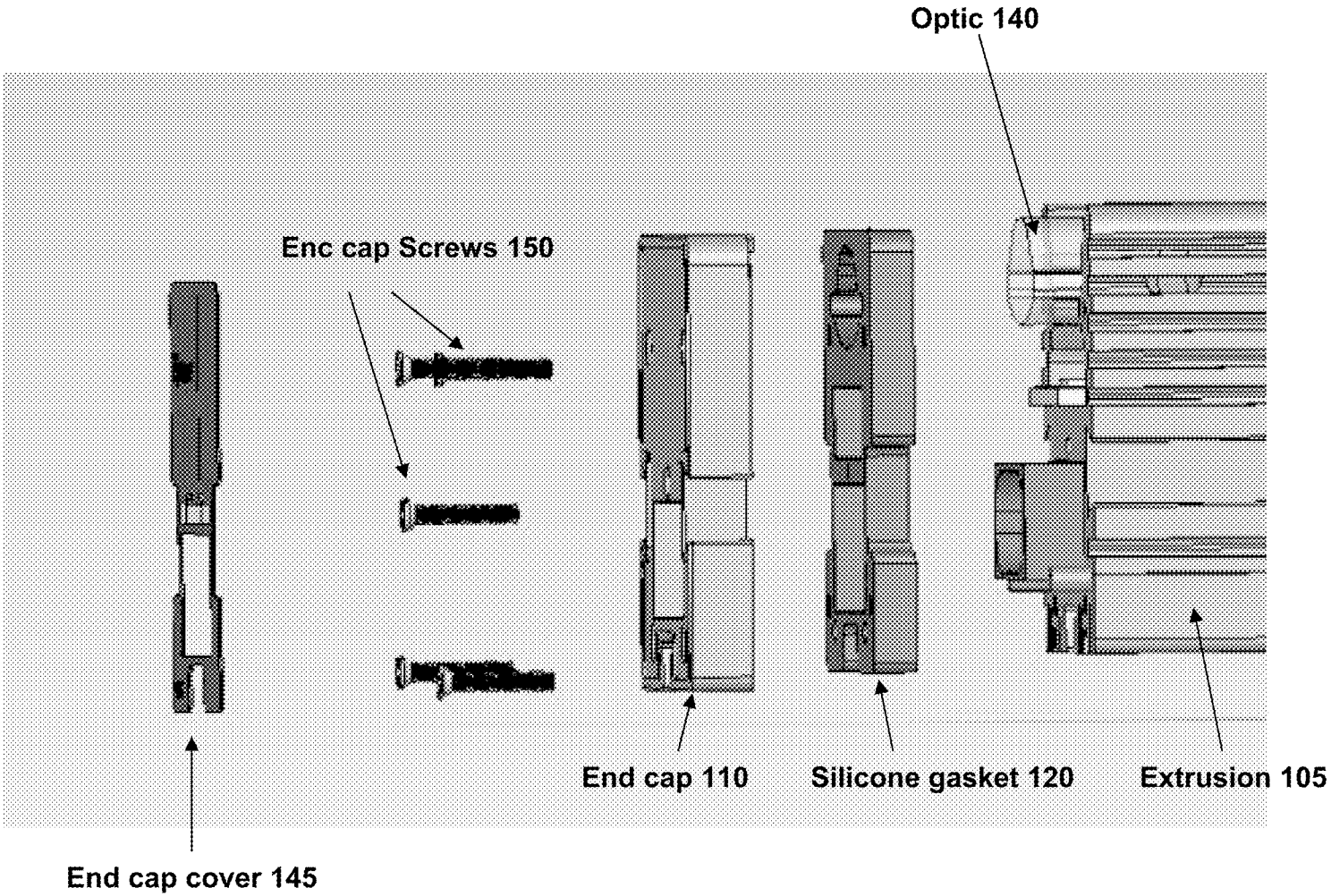
FIG. 3 is a diagram of disassembled components of a lighting fixture enclosure.

Referring now to FIG. 3, an embodiment of components of the enclosure 100 is depicted. Extrusion 105 comprises the optic 140 inserted into the extrusion and is pressing against the extrusion. The o-ring 130 is positioned between the optic 140 and the extrusion 105 walls. An embodiment of a silicone gasket 120 is presented. The silicone gasket 120 comprises a specific shape of a through hole for inserting the optic 140. End cap 110 is shown separated from the silicone gasket 120. However, end cap 110 comprises a hole into which the silicone gasket 120 is inserted and fitted. End cap screws 150 may be used to screw the end cap 110 into the extrusion 105. The screws 150 further additionally compress the silicone gasket 120 against the optic 140, o-ring 130 and other components of the enclosure 100. The silicone gasket 120 compressed by the screws 150 fill in any remaining openings or gaps inside or around the space confined by the end cap 110 and the extrusion 105. Since the silicone gasket 120 comprises an elastic, flexible and deformable material any changes or movements by the optic 140 may not result in leakage as the silicone gasket 120 may maintain seal between these components. End cap cover 145 may be attached to the end cap 110.

Figure 4:
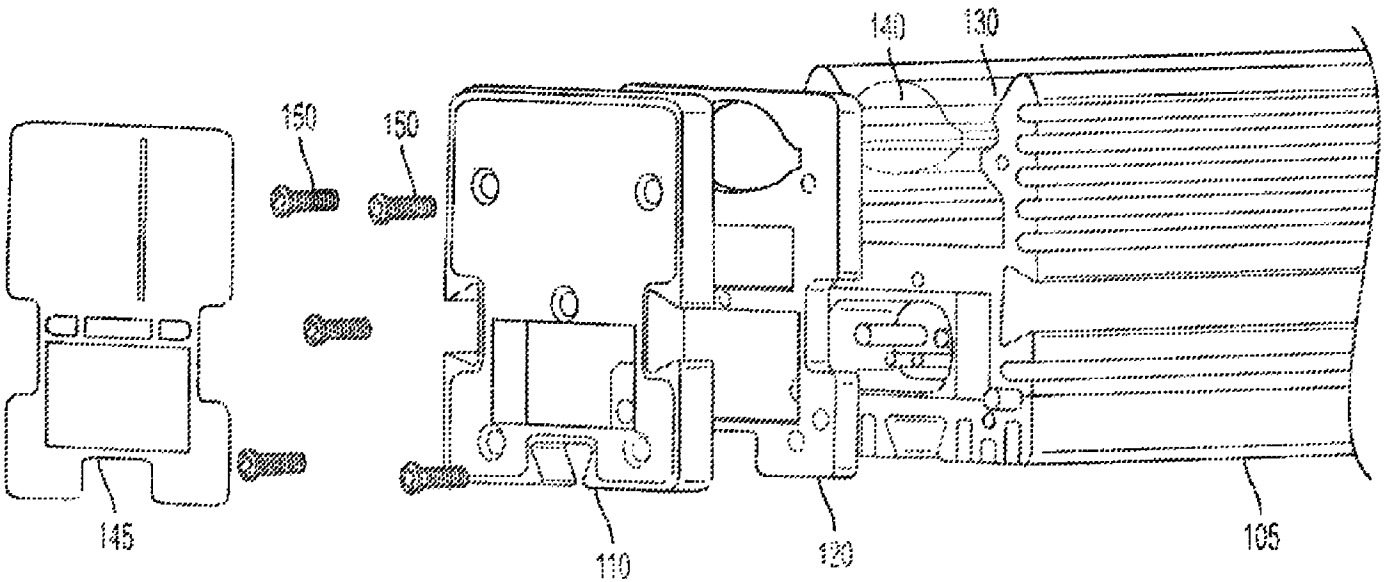
FIG. 4 is a diagram of another view of disassembled components a lighting fixture enclosure.
Figure 5:
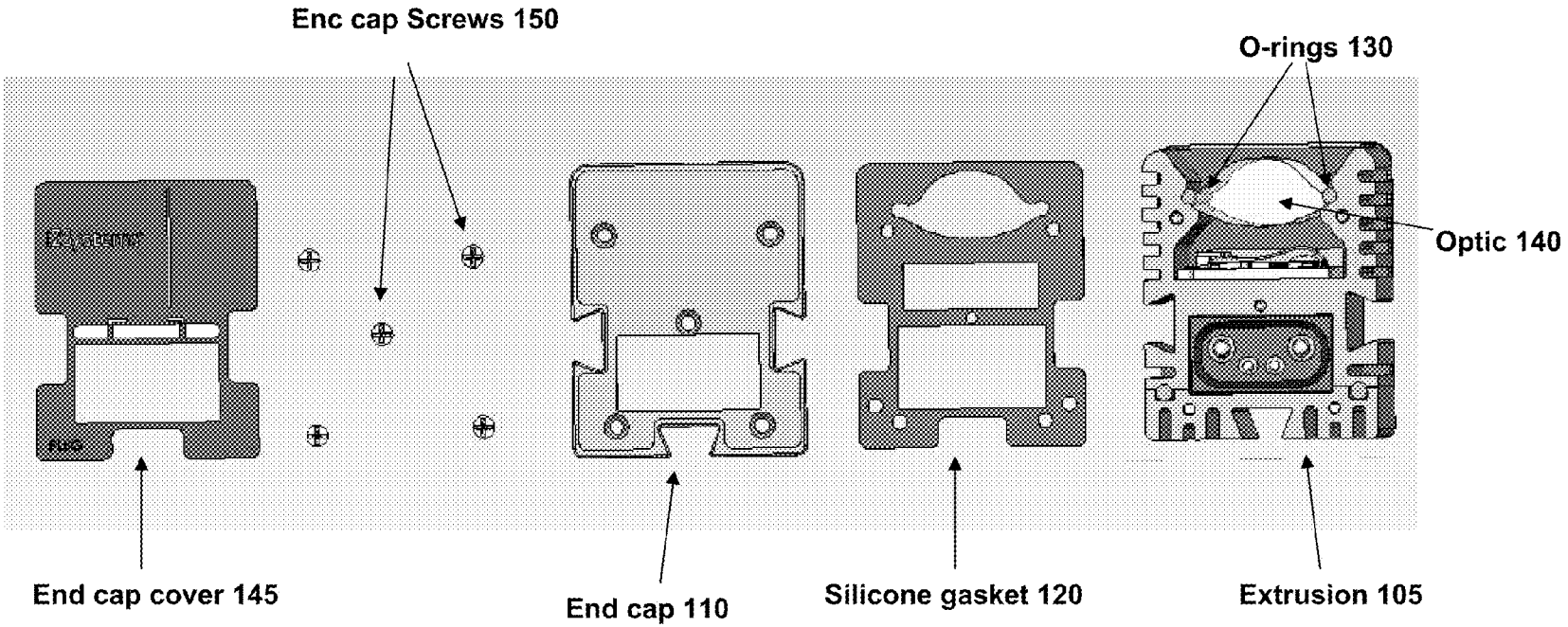
FIG. 5 is a diagram of another view of disassembled components of a lighting fixture enclosure.

Referring now to FIG. 4 and FIG. 5, diagrams of two points of view of the embodiment of components of the enclosure 100 are depicted. In FIG. 4, the components are arranged similarly as in FIG. 3. FIG. 5 depicts a cross-sectional plane, or the width-height plane of the components of the enclosure 100. The extrusion 105, silicone gasket 120, end cap 110, screws 150 and end cap cover 145 are positioned in a manner to be easily assembled. As shown in FIG. 5, silicone gasket 120 comprises a turtle-shell resembling shape that matches the same shape of the cross-sectional plane of the optic 140.

Figure 6:
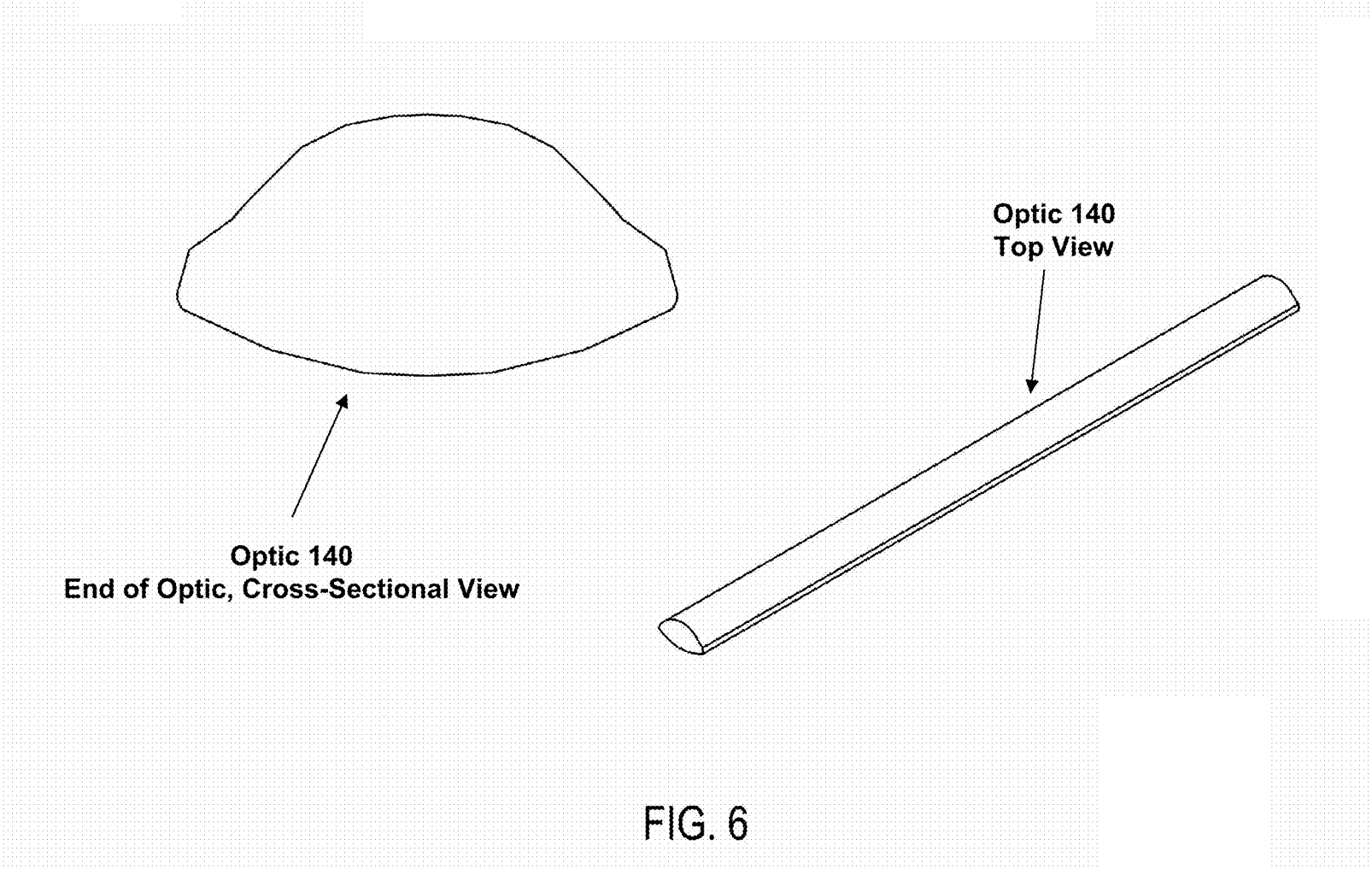
FIG. 6 is a schematic diagram of an embodiment of an optic of the lighting fixture enclosure.

Referring now to FIG. 6, a schematic drawing of an embodiment of the optic 140 is illustrated. The optic 140 may be anywhere between 1 centimeter and 30 meters long. Depending on the embodiments, the optic 140 may comprise any length. The length of the optic 140 may be depended on the specific designs or demands of the application. As the seal is maintained regardless of the length of the optic 140, any length of the optic 140 may be acceptable. In some embodiments, optic 140 is between 22.15 and 22.65 mm wide, such as 22.40 mm for example. The thickness of the optic may be between 11.50 and 12.26 mm, such as 11.75 mm for example. The tapered edge of the optic 140 may be about 1.84 mm wide. The shape of the optic may include the shape and dimensions as presented in FIG. 6, as well as any other shapes or dimensions known in the arts.

Referring now to FIG. 7, a schematic drawing of an embodiment of an o-ring 130 is depicted. Any number of o-rings, such as o-ring 130 may be used for enclosure 100. The o-ring 130 may comprise any number of dimensions or sizes, depending on the design and application. In some embodiments, o-ring 130 is 0.109 inches in diameter. In some embodiments, the o-ring 130 may comprise a diameter of anywhere between 0.05 inches to 0.4 inches. In some embodiments, o-ring 130 is between 10.875-11.125 inches in length, such as for example 11 inches. In further embodiments, o-ring 130 is between 12.375-12.625 inches in length, such as for example 12 inches. In still further embodiments, o-ring 130 is between 16.875 and 17.125 inches in length, such as for example 17 inches. In still further embodiments, o-ring 130 is between 18.375-18.625 inches in length, such as for example 18.50 inches. In yet further embodiments, o-ring 130 is between 22.875-23.125 inches in length, such as for example 23 inches. In still further embodiments, o-ring 130 is between 24.375 and 24.625 inches in length, such as for example 24.5 inches. In yet further embodiments, o-ring 130 is between 34.875-35.125 inches in length, such as for example 35 inches. In yet further embodiments, o-ring 130 is between 36.375 and 36.625 inches in length, such as for example 36.5 inches. In still further embodiments, o-ring 130 is between 46.875 and 47.125 inches in length, such as for example 47 inches. In yet further embodiments, o-ring 130 is between 48.375 and 48.625 inches in length, such as for example 48.50 inches.

Figure 8:
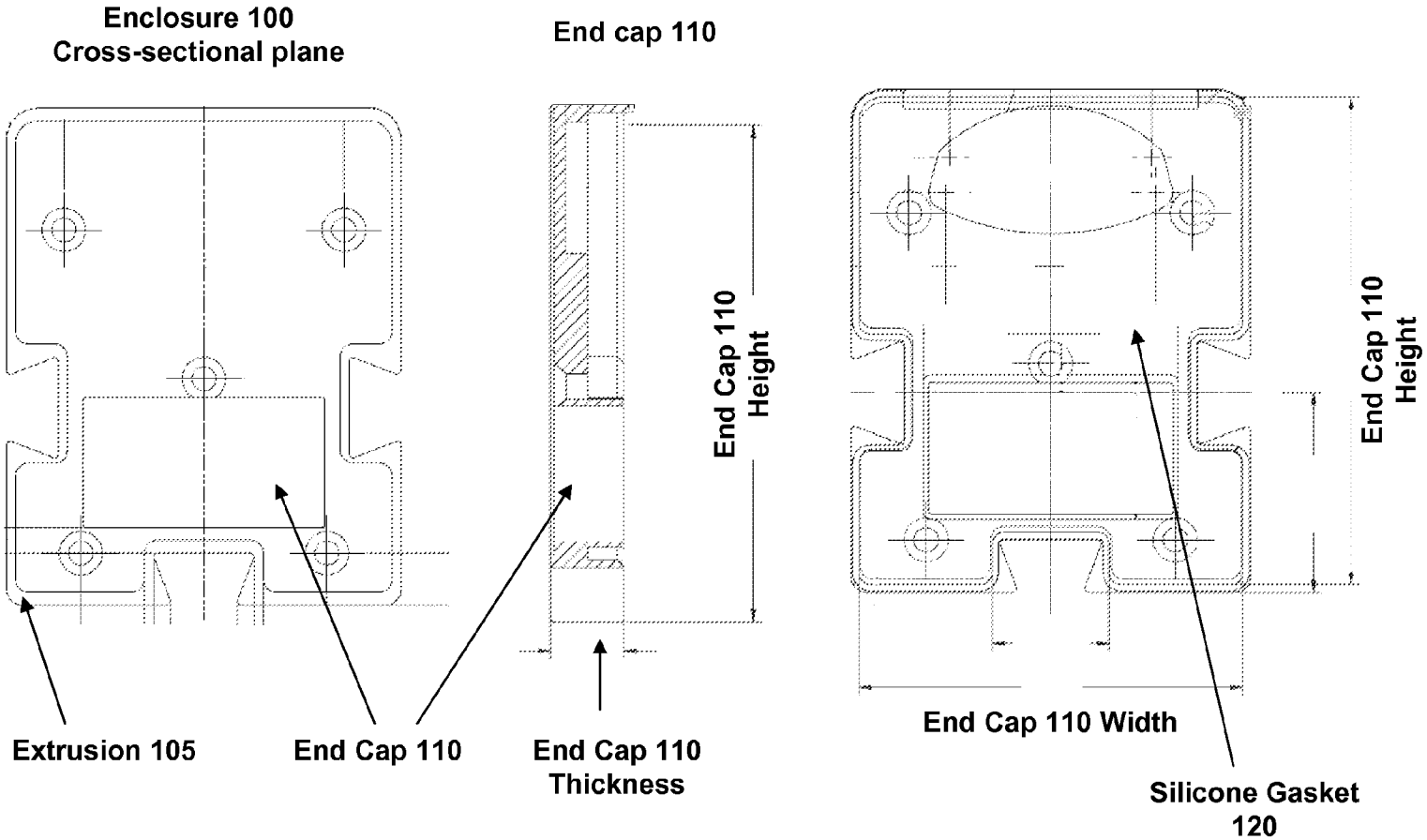
FIG. 8 is a schematic diagram of a cross-sectional view of an embodiment of an end cap and a silicone gasket of the lighting fixture enclosure.

Referring now to FIG. 8, schematic drawings of cross-sectional (width-height) plane view and a height-thickness plane view of an end cap 110 is depicted. Dimensions and sizes of the components of the enclosure 100, such as those depicted may vary between designs. The illustration also depicts a height-thickness plane view of the end cap 110. The silicone gasket 120 may be enclosed within the end cap 110. The thickness of the end-cap 110 may be about 0.278 inches. The opening within which the silicone gasket 120 is housed may be about 1.889 inches high and about 0.263 inches thick. However, these and other dimensions may vary between different designs, depending on the application.

Figure 9:
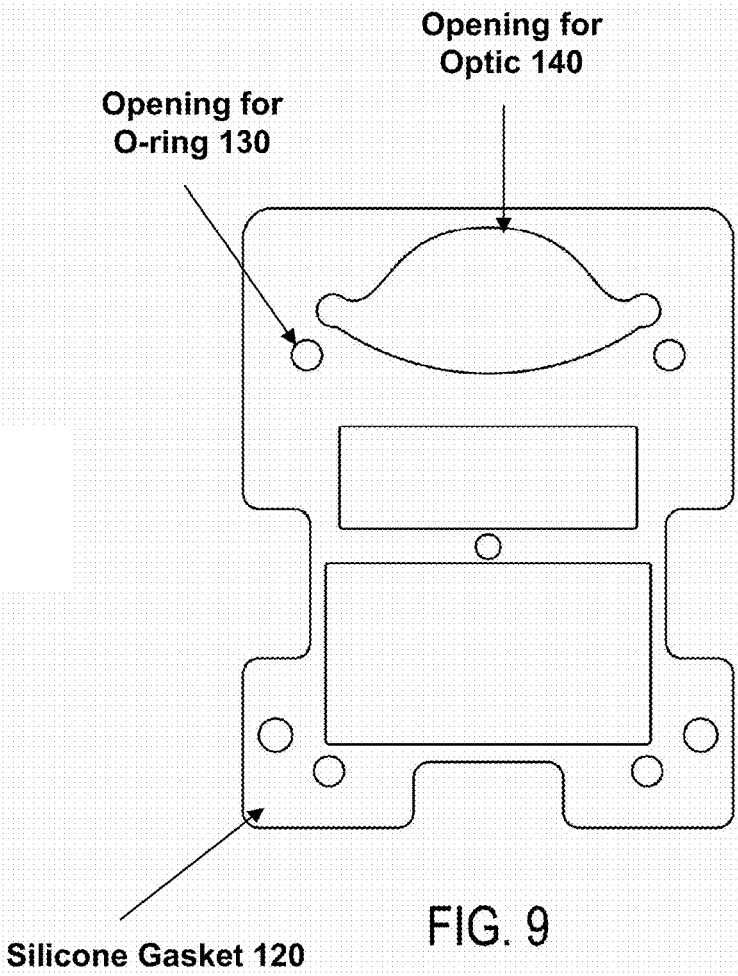
FIG. 9 is a schematic diagram of a cross-sectional view of an embodiment of an end cap along with a silicone gasket of the lighting fixture enclosure.

Referring now to FIG. 9, a schematic drawing of a width-height plane of an assembled enclosure 100 is depicted. The embodiment depicted may be an assembled enclosure 100. In this embodiment, the width of the enclosure may be about 1.56 inches. The total height of the enclosure may be about 1.907 inches. The o-ring 130 may be positioned about 1.455 from the bottom of the enclosure 100. The sides of the optic 140 may be positioned at a height of about 1.59 inches from the bottom of the enclosure 100. The bottom of the edge of the optic 140 may be positioned about 0.34 inches from the top of the enclosure 100. Dimensions and details of the design may vary across the applications.

What is claimed is:

1. An apparatus providing a water-proof enclosure of an optic of a lighting fixture, the apparatus comprising:

an enclosure having a plurality of connected rectangular sides;

an optic of a lighting fixture inserted into an extrusion forming the enclosure, the extrusion having a fixed cross-sectional profile and interfacing with one or more o-rings between the optic and walls within the extrusion, the optic expanding when heated and contracting when cooled at a different rate than the extrusion;

a deformable gasket at an end of the extrusion comprising at least one hole for receiving an end of the optic and the one or more o-rings;

an end cap of the enclosure comprising a cavity to receive the deformable gasket;

wherein inserting an end of the optic into the hole of the deformable gasket received by the end cap and securing the end cap to the extrusion provides a water-proof seal around the end of the optic, the deformable gasket and the extrusion; and wherein the deformable gasket maintains the water-proof seal during expansion and contraction of the optic.

2. The apparatus of claim 1, wherein the deformable gasket comprises a silicone material having a predetermined hardness and flexibility.

3. The apparatus of claim 1, wherein a second deformable gasket at a second end of the extrusion received by a second end cap comprises at least a second hole for receiving a second end of the optic and the one or more o-rings, and wherein the second deformable gasket at the second of the extrusion secured by the second end cap provides a water-proof seal around the second end of the optic and the one or more o-rings when the second end of the optic is inserted into the second hole.

4. The apparatus of claim 3, wherein the one or more o-rings along with the deformable gasket and the second deformable gasket maintain the waterproof seal between all sides of the optic and the walls the extrusion and the end cap and the second end cap during expansion and contraction of the optic.

5. The apparatus of claim 4, wherein the deformable gasket and the second deformable gasket maintain the water-tight seal between the ends of the optic while the o-rings maintain the water-tight seal between a first side of the optic and a first wall of the extrusion and between a second side of the optic and a second wall of the extrusion during expansion or contraction of the optic, the first wall of the extrusion and the second wall of the extrusion adjacent to the end cap and the second end cap.

6. The apparatus of claim 1, wherein the optic is shaped to bend along a cross-section of the optic and apply pressure against walls of the extrusion via the one or more o-rings during contraction of the optic and during expansion of the optic.

7. The apparatus of claim 1, wherein the optic length from the end of the optic to a second end of the optic is at least four feet long.

8. The apparatus of claim 1, wherein the extrusion along the length of the optic is at least four feet long.

9. An enclosure providing a water-tight seal of a lighting fixture, the enclosure comprising:

an extrusion forming an enclosure for a lighting fixture, the extrusion having a fixed cross-sectional profile and comprising an optic;

one or more o-rings having a predetermined size, flexibility and hardness to provide a water tight interface between the optic and the extrusion, the optic exerting pressure between the one or more o-rings and walls within the extrusion;

a deformable gasket having a predetermined thickness to exert pressure against an end of the optic upon connecting an end cap to an end of the extrusion, the end cap comprising a hole for fitting the deformable gasket, wherein upon heating of the optic by the lighting fixture, the optic expands at a different rate than the extrusion and the end of the optic presses against the deformable gasket to maintain a water-tight seal, the deformable gasket deformable to contract to compensate for the expansion of the optic;

wherein upon cooling of the optic, the optic contracts at a different rate than the extrusion and the deformable gasket maintains the water-tight seal with the end of the optic as the end of the optic contracts, the deformable gasket deformable to expand to compensate for the contraction of the optic.

10. The enclosure of claim 9, wherein the one or more o-rings maintain the water-tight seal between the optic and the walls of the extrusion as the optic expands upon heating and as the optic contracts upon cooling.

11. The enclosure of claim 10, wherein the enclosure further comprises:

a second deformable gasket having a second predetermined thickness to press against a second end of the optic upon and fitting within a hole of a second end cap at a second end of the extrusion, wherein upon heating of the optic, the second end of the optic presses against the second deformable gasket to maintain a water-tight seal, the second deformable gasket deformable to contract to compensate for the expansion of the optic; and wherein upon cooling of the optic, the second deformable gasket maintains the water-tight seal with the second end of the optic as the second end of the optic expands to compensate for the contraction of the optic.

12. The enclosure of claim 11, wherein the length of the optic between the first end and the second end is at least four feet long.

13. The apparatus of claim 11, wherein the optic is shaped to bend along a cross-section of the optic and apply pressure between the optic and the walls of the extrusion via the one or more o-rings during the contraction of the optic and during the expansion of the optic.

14. The enclosure of claim 10, wherein the first end cap and the second end cap are applying pressure against the deformable gasket and the second deformable gasket and providing a water-tight seal.

15. An enclosure providing a water-tight seal of a lighting fixture, the enclosure comprising:

an extrusion forming an enclosure for a lighting fixture, the extrusion having a fixed cross-sectional profile and comprising an optic;

one or more o-rings having a predetermined hardness and sized to fit between the optic and the extrusion, the optic constructed to exert pressure between the one or more o-rings and walls within the extrusion;

a deformable gasket to exert pressure against the optic upon fitting within an end cap of the extrusion, the end cap connected to the extrusion, wherein upon heating of the optic by the lighting fixture, the optic expands at a different rate than the extrusion and presses against the deformable gasket to provide a water-right seal, the deformable gasket contracting to compensate for the expanding optic;

wherein upon cooling of the optic, the optic contracts at a different rate than the extrusion and the deformable gasket maintains the water-tight seal by expanding to compensate for the contracting optic.

16. The enclosure of claim 15, wherein the deformable gasket comprises one of a rubber, silicone, latex or elastic polymer material.

17. The enclosure of claim 16, wherein the deformable gasket comprises the material with an elongation percentage of about 720 when press cured at 5 minutes at 166 Celsius.

18. The enclosure of claim 17, wherein the deformable gasket comprises the material having tear strength of about 15 kN/m when press cured for about 5 minutes at 166 Celisus.

19. The apparatus of claim 1, wherein the deformable gasket comprises a flexible and deformable material having tensile strength of about 6.5 MPa when press cured for 5 minutes at 166 C.

20. A lighting fixture providing a water-tight seal to optical components, the lighting fixture comprising:

an acrylic optic positioned along a length of an opening of an extrusion forming an enclosure, the extrusion having a fixed cross-sectional profile;

an o-ring positioned between the acrylic optic and walls within the extrusion, the o-ring providing a pressure and a seal between the acrylic optic and the walls within the extrusion;

an end cap enclosing a deformable gasket interfacing with an end of the acrylic optic extruding from the extrusion;

wherein deformation by the deformable gasket and the o-ring fills in gaps created by movement of the acrylic optic responsive to heating or cooling from the lighting fixture, the deformable gasket and the o-ring contracting and expanding to maintain a water-tight seal with the acrylic optic, wherein the acrylic optic expands or contracts at a different rate than the extrusion.

* * * * *